US012546121B1

(12) United States Patent
Peeters

(10) Patent No.: US 12,546,121 B1
(45) Date of Patent: Feb. 10, 2026

(54) WALL PANEL OR FLOOR PANEL HAVING LOCKING MEANS WHICH ARE SUITABLE FOR MULTIPLE PROFILES

(71) Applicant: CLYX BV, Sint-Niklaas (BE)

(72) Inventor: Ivan Peeters, Beveren (BE)

(73) Assignee: CLYX BV, Sint-Niklaas (BE)

( * ) Notice: Subject to any disclaimer, the term of this patent is extended or adjusted under 35 U.S.C. 154(b) by 0 days.

(21) Appl. No.: 19/036,578

(22) Filed: Jan. 24, 2025

Related U.S. Application Data

(63) Continuation of application No. PCT/EP2024/087615, filed on Dec. 19, 2024.

(30) Foreign Application Priority Data

Nov. 7, 2024 (WO) ..... PCT/EP2024/081551

(51) Int. Cl.
*E04F 15/02* (2006.01)
*E04F 13/08* (2006.01)

(52) U.S. Cl.
CPC .... *E04F 15/02038* (2013.01); *E04F 13/0894* (2013.01); *E04F 2201/01* (2013.01); *E04F 2201/02* (2013.01)

(58) Field of Classification Search
CPC ..... E04F 15/02038; E04F 13/0894; E04F 2201/01; E04F 2201/02
See application file for complete search history.

(56) References Cited

U.S. PATENT DOCUMENTS

| | | | | |
|---|---|---|---|---|
| 6,385,936 | B1 * | 5/2002 | Schneider | E04F 15/02 52/592.1 |
| 6,584,747 | B2 * | 7/2003 | Kettler | E04F 15/04 52/592.4 |
| 6,685,391 | B1 * | 2/2004 | Gideon | E02B 3/14 405/20 |
| 8,353,140 | B2 * | 1/2013 | Pervan | H01F 7/0252 52/578 |
| 8,499,521 | B2 * | 8/2013 | Pervan | H04M 1/0256 52/586.1 |
| 11,326,354 | B2 | 5/2022 | Bouckéet al. | |
| 11,459,774 | B2 * | 10/2022 | Fahle | E04F 13/0894 |
| 12,123,204 | B2 * | 10/2024 | Fahle | E04F 13/0894 |
| 2004/0168392 | A1 * | 9/2004 | Konzelmann | E04F 15/04 52/592.1 |
| 2009/0133353 | A1 * | 5/2009 | Pervan | H01F 7/122 52/747.1 |
| 2013/0097959 | A1 | 4/2013 | Michel | |
| 2014/0325930 | A1 * | 11/2014 | Schneider | E04F 15/02038 52/588.1 |
| 2024/0052642 | A1 * | 2/2024 | Whispell | E04F 15/02038 |
| 2024/0247497 | A1 | 7/2024 | Sieder et al. | |

FOREIGN PATENT DOCUMENTS

| | | |
|---|---|---|
| DE | 20203311 | 5/2002 |
| WO | 2014033628 | 3/2014 |

* cited by examiner

*Primary Examiner* — Gisele D Ford
(74) *Attorney, Agent, or Firm* — Hodgson Russ LLP

(57) ABSTRACT

The invention relates to an improved multi-purpose tile system and the associated tiles, allowing a simplified coupling in multiple configurations and angles of approach, while ensuring a reliable coupling once secured.

27 Claims, 9 Drawing Sheets

WALL PANEL OR FLOOR PANEL HAVING LOCKING MEANS WHICH ARE SUITABLE FOR MULTIPLE PROFILES

CROSS-REFERENCE TO RELATED APPLICATIONS

This application is a continuation of International Application No. PCT/EP2024/087615, filed Dec. 19, 2024, which claims priority to International Application No. PCT/EP2024/081551, filed Nov. 7, 2024, the entire disclosures of which are hereby incorporated herein by reference.

BACKGROUND OF THE INVENTION

The invention relates to a multi-purpose tile system, in particular a floor tile system, which comprises various multi-purpose tiles, in particular floor tiles, wall tiles, or ceiling tiles. The invention also relates to tile coverings, in particular floor coverings, ceiling coverings, or wall coverings, comprising interconnected tiles according to the invention.

The invention relates, in the first instance, to a connection of a tile comprising a tongue-and-groove connection for use in a multifunctional tile system. According to the invention, the configuration on both the longitudinal side and the end side is identical.

An extension of the first concept of the invention is a connection comprising several tooth systems in combination with a groove system in which the different tooth systems can be connected end-to-end, enabling the formation of various patterns with just one type of tile.

DESCRIPTION OF THE RELATED ART

Some forms of vertical connection systems or drop-lock systems for a surface covering panel may contain male and female parts. The male and female parts are formed along the sides of the panel. The male and female parts work together to connect corresponding panels when they are moved towards each other in a direction perpendicular to the plane of the panels. When the panels are floor panels, this direction is vertical. The male and female parts have surfaces that come into contact with each other to prevent the vertical separation of connected panels.

A potential problem with vertical connection systems is "lipping". Lipping occurs when the top edge of a panel rises relative to the top edge of the adjacent panel. This creates a lip on the top edges of adjacent joined panels. To reduce lipping, it is common to position the contact surfaces of the male and female parts at the front of the joints. The front end of the joint is the end closest to the top edge of the top surface of the panels.

An example of this is shown in the U.S. Patent No. U.S. Ser. No. 11/326,354B2, in which the front of a male part forms a surface with a locking heel that contacts a locking surface that has been formed on the front surface of a female part. An alternative practice is to use separately manufactured plastic inserts or clips mounted inside the panels. However, this adds to the cost of production, and the inserts/clips sometimes fall out of the panels during transportation and handling. The state of the art is also known from US 2013/097959 A1 and DE20203311 U1. WO 2014/033628 A1 discloses a panel equipped with coupling parts that allow it to connect with a downward movement. The coupling parts consist of a male part that fits into a female part, with vertically active locking parts on either side of the male and female parts. The locking parts are positioned at different distances from the top of the panels.

The so-called drop-lock systems are designed for rectangular tiles at the ends, mainly in combination with a click system in which the lip of one panel fits into the opening of the other panel so that the coupling system at the end is always different from the coupling system used on the longitudinal side.

It is a first object to provide a multifunctional flooring system for interconnected tiles that prevents lipping.

It is a second object to provide a multifunctional floor system that offers a coupling system suitable for both the end and the longitudinal side.

It is a third object to provide a multifunctional flooring system that enables the formation of different patterns with just one type of tile, such as the herringbone pattern.

An example of a patent that enables the formation of a herringbone pattern with just one plank can be found in the patent with No. US2024247497A1. It describes a coupling system consisting of three different types of couplings each of which can be interconnected. The disadvantage of the technique, as described in this patent, is that the strength of the couplings is limited, making them susceptible to coming loose relatively easily or, in other words, prone to so-called lipping.

SUMMARY OF THE INVENTION

At least one of the first two objects can be achieved by providing a multipurpose system according to a first embodiment, where tiles are configured to be joined together in a pattern where the end of a tile can be linked to the longitudinal side of a contiguous tile, where each tile comprises a top and a bottom, and further comprises: a first pair of opposite edges consisting of a first edge and an opposite second edge; a second pair of opposite edges, consisting of a third edge and an opposite fourth edge, preferably where the first edge and the third edge enclose a first corner, and where the second edge and the fourth edge enclose a second corner opposite to the said first corner.

The first edge comprises a first mechanical coupling part comprising a lateral tongue, the lateral tongue being connected to the first edge via a recessed connection section, the connection section being formed by a blocking recess that extends from the bottom of the tile in the direction of the top of the tile, wherein the lateral tongue comprises a distally downward sloping bottom side.

The second edge includes a second mechanical coupling part, configured to cooperate with the first mechanical coupling part of another of such tiles so as to couple two of such tiles together, the second mechanical coupling part comprising a lower lip and an upper lip defining a recess, said recess configured for accommodating the lateral tongue of a second of the tiles so that two of such tiles, when coupled, are locked together in a vertical direction, wherein the lower lip extends beyond the distal end of the upper lip, and comprises a blocking lip at its distal end, wherein the blocking lip is configured to be accommodated in the blocking recess of a second of the tiles, so that two of such tiles, when coupled, are locked together in a horizontal direction, and wherein the lower lip is configured to elastically bend downwards upon coupling two of such tiles, so as to be able to push the lateral tongue, with the blocking lip against the distally downward sloping bottom side of the lateral tongue, into the recess defined by the upper lip and the lower lip when returning fully or partially to its relaxed state.

In the present invention, the combination is made of a coupling in which a tongue of the first coupling profile is inserted into the recess of the second coupling profile using a tilting movement, with a so-called drop-lock coupling in which the tongue of the first coupling profile is inserted into the recess of the second coupling profile using a vertical pushing movement.

According to a general embodiment of the invention, the combination of the first and second coupling profiles can be used as a coupling between two tiles, where a coupling can be formed by making a tilting movement or a vertical pushing movement.

According to a preferred embodiment, the distally downward sloping bottom side of the lateral tongue forms an angle (A) with a plane parallel to the tile of at least 5 degrees, preferably at least 10 degrees, more preferably between 10 and 45 degrees.

According to a preferred embodiment, the blocking lip, at its upper side, comprises a guiding surface sloping downwards towards the recess formed by the upper lip and the lower lip, this guiding surface being configured to cooperate with the distally downward sloping bottom side of the tongue so as to guide the lateral tongue, upon coupling two of such tiles together, into the recess formed by the upper lip and the lower lip.

According to a preferred embodiment, the lower lip comprises a distally upwardly sloping bottom side allowing the lower lip to elastically bend downwards during coupling of two of such multi-purpose tiles, thereby enlarging the recess defined by the upper lip and the lower lip for insertion of the lateral tongue.

According to a preferred embodiment, the first mechanical coupling part and the second mechanical coupling part are configured so as to allow coupling two of such tiles by a scissoring movement of one tile with respect to the other tile along the respective edges.

According to a preferred embodiment, the lateral tongue into the recess is defined by the upper lip and the lower lip when the tile reaches a horizontal orientation during said scissoring movement.

According to a preferred embodiment, the first mechanical coupling part and the second mechanical coupling part are configured to allow two of such tiles to be coupled using a scissoring movement of one tile with respect to the other tile, as well as using a turning movement of one tile with respect to the other tile.

According to a preferred embodiment, the lateral tongue transitions into the recessed connection section via a downward side flank, positioned proximally from the distally downward sloping bottom side of the lateral tongue, and wherein the blocking lip comprises an inside flank, which is configured to cooperate with the downward side flank of the lateral tongue to lock two of such tiles together in the horizontal direction.

According to a preferred embodiment, the lateral tongue comprises, at its upper side, a first locking surface, and wherein the upper lip includes, at its lower side, a second locking surface, which is configured to cooperate with the first locking surface of the lateral tongue to lock two of such tiles together in the vertical direction.

According to a preferred embodiment, the lateral tongue comprises, at its upper side, a guiding surface sloping downward towards the distal end of the tongue, and wherein the upper lip includes, at its lower side, a guiding surface sloping upwards towards the distal end of the upper lip, which is configured to cooperate with the guiding surface at the upper side of the tongue so that, upon coupling two of such tiles, the lateral tongue is guided into the recess formed by the upper lip and the lower lip.

According to a preferred embodiment, the respective guiding surfaces at the upper side of the lateral tongue and the lower side of the upper lip are configured to cooperate when the lower lip pushes the lateral tongue into the recess defined by the upper lip and the lower lip.

According to a preferred embodiment, the lateral tongue and the recess defined by the upper lip and downward lip are configured so that, when two of such tiles are coupled together, the lateral tongue is clamped into the recess.

According to a preferred embodiment, the lower lip is configured to bend back only partially when two of such tiles are coupled so that the lateral tongue is clamped into the recess.

According to a preferred embodiment, the recessed connection section has a thickness lower than half of the thickness of the tile, preferably lower than a quarter of the thickness of the tile.

According to a preferred embodiment, the distally downward-sloping bottom side of the tongue slopes downward over at least 50% of the maximum width of the lateral tongue, preferably over at least 75% of the maximum width of the lateral tongue and more preferably over at least 90% of the width of the lateral tongue.

According to a preferred embodiment, the slope of the top and bottom of the lower lip is substantially equal to the slope of the bottom of the lateral tongue.

According to a preferred embodiment, the upper lip comprises a beveled or chamfered distal top end, wherein when the first and second coupling parts of the tiles are coupled, whereby said beveled or chamfered distal top end form a gully with the chamfered or beveled top of the lateral tongue.

According to a preferred embodiment, the bottom of the lateral tongue comprises a downward extending tooth at the distal end thereof, said tooth defining an additional point at the apex of the tooth, wherein the tooth is defined by two lateral flanks which have a greater slope than the slope of the bottom of the lateral tongue. The recess of the second coupling comprises an additional recess at the proximal end thereof, near the second edge, said additional recess being defined by two lateral flanks which have a greater slope than the slope of the bottom of the recess. The additional recess is configured for accommodating the tooth and the additional point when the first and second couplings of the tiles are coupled.

According to a further preferred embodiment, the lower lip is connected to the second edge via a spring point or spring point section at the additional recess.

According to a preferred embodiment, the lower lip comprises an extra protrusion at the bottom part near the second edge, which extra protrusion forms an extension of the bottom of the tile parallel thereto over part of the length of the lower lip, wherein said part is horizontally distanced from the proximal flank of the blocking lip by a predetermined minimal length.

According to a further preferred embodiment, the extra protrusion forms a right angle with respect to the bottom of the tile, towards the bottom of the lower lip.

According to a preferred embodiment, the first mechanical coupling part and/or the second mechanical coupling part are made in one piece with the respective multi-purpose tile.

According to a preferred embodiment, the multi-purpose tiles have a thickness of a maximum of 5 millimeters, preferably a thickness of a maximum of 4 millimeters.

According to a preferred embodiment, the third edge has a mechanical coupling part which has substantially the same shape as the first mechanical coupling part, and wherein the fourth edge has a mechanical coupling part which has substantially the same shape as the second mechanical coupling part.

In a variation, the invention relates to a multi-purpose tile system comprising a plurality of multi-purpose tiles, each tile having a top and a bottom, wherein each tile comprises a first pair of opposite edges consisting of a first edge and an opposite second edge, and a second pair of opposite edges consisting of a third edge and an opposite fourth edge. The first edge comprises a first mechanical coupling part comprising a lateral tongue, the lateral tongue being connected to the first edge via a recessed connection section, the connection section being formed by a blocking recess that extends from the bottom of the tile in the direction of the top of the tile, wherein the second edge comprises a second mechanical coupling part, configured to cooperate with the first mechanical coupling part of another of such tiles so as to couple two of such tiles together, the second mechanical coupling part comprising a lower lip and an upper lip defining a recess, said recess configured for accommodating the lateral tongue of a second of the tiles, so that two of such tiles, when coupled, are locked together in a vertical direction, wherein the lower lip extends beyond the distal end of the upper lip, the lower lip comprising a blocking lip at the distal end thereof, wherein the blocking lip is configured for being accommodated in the blocking recess of a second of the tiles, so that two of such tiles, when coupled, are locked together in a horizontal direction, wherein the first mechanical coupling part and the second mechanical coupling part are configured so as to allow coupling two of such tiles together by a scissoring movement of one tile with respect to the other tile along the respective edges. wherein the lower lip is configured to elastically bend downwards upon coupling two of such tiles by means of said scissoring movement, so as to be able to push the lateral tongue into the recess defined by the upper lip and the lower lip when returning fully or partially to its relaxed state According to a further preferred embodiment, the lateral tongue is moved at least in a horizontal direction when pushed by the lower lip into the recess defined by the upper lip and the lower lip.

Throughout this document, the embodiments and versions are envisioned to be implementable in any one of the aspects, embodiments or versions as described above, as well as those below.

According to a preferred embodiment, the lateral tongue comprises a further lower lip and a further upper lip defining a further recess, wherein the further lower lip extends beyond the distal end of the further upper lip, the further lower lip comprising a further blocking lip at the distal end thereof, wherein the further upper lip comprises a facial surface protruding distally at the bottom of the further upper lip, wherein, when two of such tiles are coupled, the facial surface is positioned at least partly beneath the upper lip, such that the two tiles are locked together in a vertical direction, and wherein the further lower lip is configured to elastically bend upwards upon coupling of the two tiles so as to be able to push the facial surface against the upper lip when the further lower lip returns fully or partially to its relaxed state.

According to a preferred embodiment, the system comprises one or more additional tiles which each comprise a first pair of opposite edges consisting of a first edge and an opposite second edge, and a second pair of opposite edges consisting of a third edge and an opposite fourth edge. At least one of the edges of the additional tiles includes a third mechanical coupling part, configured to cooperate with either a first mechanical coupling part as described in the previous embodiment, or a second mechanical coupling part of a second of the tiles so as to couple the additional and the second tiles together, the third mechanical coupling part comprises a third locking means being connected to an edge of the additional tile via a recessed connection section, the connection section being formed by a first blocking recess that extends from the bottom of the additional tile in the direction of the top of the additional tile, wherein the third locking means comprises at its distal end a head side at the upper part and a tooth at the lower part, wherein a head flank recess extends into the distal end of the third locking means and separates the head side and the tooth, wherein the tooth protrudes further than the head side, and comprises a distally downward sloping bottom side. The third locking means comprises a second blocking recess that extends from the bottom of the additional tile in the direction of the top of the additional tile at a more distal position than the first blocking recess, and wherein an intermediate profile between the first and second blocking recess slants downwardly in a distal direction, and wherein the second blocking recess is positioned between the intermediate profile and the tooth. When the third mechanical coupling part is coupled with a first mechanical coupling part of a second of the tiles, the tooth is configured to be accommodated in the further recess and the facial surface to be accommodated in the head flank recess so that the additional and the second tile, when coupled, are locked together in a vertical direction, and wherein the further blocking lip is configured to be accommodated in the second blocking recess, so that the additional and the second tile, when coupled, are locked together in a horizontal direction, and wherein the further lower lip is configured to elastically bend downwards upon coupling the additional and second tiles, so as to be able to push the third mechanical coupling part, with the further blocking lip against the distally downward sloping bottom side of the tooth, into the further recess defined by the further upper lip and the further lower lip when returning fully or partially to its relaxed state. When the third mechanical coupling part is coupled with a second mechanical coupling part of a second of the tiles, the head side and the upper lip are configured to interface, and the tooth is configured to be accommodated in the recess against the bottom side of the upper lip, so that the additional and the second tiles, when coupled, are locked together in a vertical direction, and wherein the blocking lip of the second mechanical coupling part is configured for being accommodated in the first blocking recess of the third mechanical coupling part, so that the additional and second tiles, when coupled, are locked together in a horizontal direction, and wherein the lower lip of the second mechanical coupling part is configured to elastically bend downwards upon coupling the additional and second tiles, so as to be able to push the third mechanical coupling part, and in particular the tooth, with the blocking lip of the second mechanical coupling part against the distally downward sloping bottom side of the tooth, into the recess defined by the upper lip and the lower lip of the second mechanical coupling part when returning fully or partially to its relaxed state.

According to a preferred version, the first coupling profile comprises a lateral tongue that runs parallel to the tile's surface. The front of the lateral tongue has a recess at the top that forms at least one locking device. The underside of the lateral tongue has an upward-pointing sloping flank in the direction of the tile. The lateral tongue is formed at the back by an upward-facing blocking recess positioned between the lateral tongue and the tile and preferably has a rectangular shape.

According to a preferred version, the second coupling profile comprises a spring-loaded lower lip with at least one vertically positioned blocking lip, at least one upward edge positioned at a distance from the vertically positioned blocking lip, and an upper lip positioned at the top of the upward edge, parallel to the upper surface of the tile and forming part of the second locking element. The underside of the upper lip has a preferably horizontal flank that forms the recess. The top of the lower lip has a bevel, at least partially, directed downwards towards the upward edge. The underside of the lower lip preferably has a recess for at least part of the underside of the lower lip formed by a flank, preferably almost parallel to the top of the lower lip. The vertically arranged blocking lip is part of the first locking device and has a shape defined to fit into the blocking recess of the first coupling profile to lock the two tiles in the horizontal direction mechanically.

The third object can be achieved by providing a multipurpose system according to an additional second embodiment, where tiles are configured to be joined in a pattern where the end of a tile can be linked to the longitudinal side of a contiguous tile, where each tile comprises: a first pair of opposite edges comprising a first edge and an opposite second edge; a second pair of opposite edges, comprising a third edge and an opposite fourth edge, where: the first edge and the third edge enclose a first corner, and where the second edge and the fourth edge enclose a second corner opposite to the said first corner, and where the first pair of opposite sides are provided with pairs of opposite first mechanical coupling devices or parts to make the said tiles attach at least vertically and preferably also horizontally, comprising:

A first type of coupling in which a first coupling profile comprises a lateral tongue with at least one additional recess extending in a direction preferably wholly or almost parallel to the top of the tile; and an opposite second coupling profile comprising a recess configured to accommodate at least part of the lateral tongue of the first coupling profile, provided with at least one additional recess, where this second coupling recess is defined by an upper lip and a lower lip, where the combination of the first mechanical coupling profile and second mechanical coupling profile allows these tiles to be connected to each other, locking by both tilting inwards and using a vertical pushing movement, carrying at least part of the lateral tongue with at least one additional recess through the recess;

A second type of coupling in which a third coupling profile comprises a tooth extending in a direction preferably parallel to the top of the tile, and an opposite second coupling profile comprising a recess configured to accommodate at least part of the tooth of the third coupling profile, where this recess is defined by an upper lip and a lower lip, where the combination of the third mechanical coupling profile and second mechanical coupling profile allows these tiles to be locked together by both tilting inwards and using a vertical pushing movement, carrying at least part of the tooth through the recess;

A third type of coupling in which a fourth coupling profile, as a variation on the first coupling profile, comprises a lateral tongue with at least one recess extending into the lateral tongue in a direction preferably parallel to the top of the tile, and an opposite third coupling profile fitted with a tooth extending in a direction preferably parallel to the top of the tile, where the first coupling profile features a recess configured to accommodate at least part of the tooth of the third coupling profile, where the combination of the first mechanical coupling profile and the third mechanical coupling profile makes it possible to lock these tiles together by both tilting inwards and using a vertical pushing movement, carrying at least part of the tooth through the recess. A possible embodiment of the fourth coupling profile is shown in FIG. 12.

In an embodiment, the third type of coupling uses a fourth coupling profile which is in essence a variation of the first coupling profile discussed in this document, where the lateral tongue comprises a further lower lip and a further upper lip defining a further recess into said lateral tongue. The further lower lip extends beyond the distal end of the further upper lip and comprises a further blocking lip at the distal end thereof, wherein the further upper lip comprises a facial surface protruding distally at the bottom of the further upper lip. When two of such tiles are coupled, the facial surface is positioned at least partly beneath the upper lip, such that the two tiles are locked together in a vertical direction, and wherein the further lower lip is configured to elastically bend upwards upon coupling of the two tiles so as to be able to push the facial surface against the upper lip when the further lower lip returns fully or partially to its relaxed state.

In an embodiment, the second type of coupling uses a third coupling profile on certain additional tiles, which comprises a third mechanical coupling part. These third coupling profiles or third mechanical coupling parts are specifically configured to interlock with both the second coupling profiles as well as the fourth coupling profiles, providing an improved flexibility which is especially useful for creating herringbone and other advanced patterns.

These third coupling profiles comprise a third mechanical coupling part, configured to cooperate with either of a first or second mechanical coupling part of a second of the tiles so as to couple the additional and the second tile together. The third mechanical coupling part comprises a third locking means being connected to an edge of the additional tile via a recessed connection section, the connection section being formed by a first blocking recess that extends from the bottom of the additional tile in the direction of the top of the additional tile, wherein the third locking means comprises at its distal end a head side at the upper part and a tooth at the lower part, wherein a head flank recess extends into the distal end of the third locking means and separates the head side and the tooth, wherein the tooth protrudes further than the head side, and comprises a distally downward sloping bottom side. The third locking means comprises a second blocking recess that extends from the bottom of the additional tile in the direction of the top of the additional tile at a more distal position than the first blocking recess, and wherein an intermediate profile between the first and second blocking recess slants downwardly in a distal direction, and wherein the second blocking recess is positioned between the intermediate profile and the tooth.

When the third mechanical coupling part is coupled with a first mechanical coupling part of a second of the tiles, the tooth is configured to be accommodated in the further recess and the facial surface is to be accommodated in the head flank recess so that the additional and the second tile, when coupled, are locked together in a vertical direction, and wherein the further blocking lip is configured to be accommodated in the second blocking recess, so that the additional and the second tiles, when coupled, are locked together in a horizontal direction, and wherein the further lower lip is configured to elastically bend downwards upon coupling the additional and second tile, so as to be able to push the third mechanical coupling part, with the further blocking lip against the distally downward sloping bottom side of the tooth, into the further recess defined by the further upper lip and the further lower lip when returning fully or partially to its relaxed state.

When the third mechanical coupling part is coupled with a second mechanical coupling part of a second of the tiles, the head side and the upper lip are configured to interface, and the tooth is configured to be accommodated in the recess against the bottom side of the upper lip, so that the additional and the second tiles, when coupled, are locked together in a vertical direction, and wherein the blocking lip of the second mechanical coupling part is configured for being accommodated in the first blocking recess of the third mechanical coupling part, so that the additional and second tiles, when coupled, are locked together in a horizontal direction, and wherein the lower lip of the second mechanical coupling part is configured to elastically bend downwards upon coupling the additional and second tiles, so as to be able to push the third mechanical coupling part, and in particular the tooth, with the blocking lip of the second mechanical coupling part against the distally downward sloping bottom side of the tooth, into the recess defined by the upper lip and the lower lip of the second mechanical coupling part when returning fully or partially to its relaxed state.

In what is described above, it is of course clear that it does not matter how the second of the tiles is configured, with a first mechanical coupling part, a second mechanical coupling part or both, but that the invention lies in the compatibility of the third mechanical coupling part with either.

The invention provides for tiles which comprise a first, second, third or fourth coupling profile on one or more edges, typically with different coupling profiles on opposite edges, and preferably wherein each tile comprises two sets of two coupling profiles (for instance, two first coupling profiles and two second coupling profiles). As such, the invention provides each combination of coupling profiles on the edges of a tile, in any configuration.

According to a general embodiment of the invention, the combination of the first and second coupling profiles can be used as a coupling between two tiles, where a coupling can be formed by making a tilting movement or a vertical pushing movement.

According to a general embodiment of the invention, the combination of the first and third coupling profiles can be used as a coupling between two tiles, where a coupling can be formed by making a tilting movement or a vertical pushing movement.

According to a general embodiment of the invention, the combination of the third and second coupling profiles can be used as a coupling between two tiles, where a coupling can be formed by making a tilting movement or a vertical pushing movement.

According to a preferred version, the first coupling profile comprises a lateral tongue that runs parallel to the tile's surface.

The front of the lateral tongue has a recess or protrusion that forms at least one locking device. The underside of the lateral tongue has at least partly an upward-pointing oblique flank in the direction of the tile. The lateral tongue is formed at the back by an upward-facing blocking recess positioned between the lateral tongue and the tile and preferably has a rectangular shape. The tongue has at least one recess that acts as a receptacle to at least part of the tongue of the third coupling.

According to a preferred version, the second coupling profile comprises a spring-loaded lower lip with at least one vertically positioned blocking lip, at least one upward flank positioned at a distance from the vertically positioned blocking lip, and an upper lip positioned at the top of the upward flank, preferably slightly oblique but possibly also parallel to the upper surface of the tile and forming part of the second locking element. The bottom of the upper lip has a flank that also forms the cut-out. The top of the lower lip preferably has a, at least partially, downward-facing bevel in the direction of the core of the tile. The bottom of the lower lip is preferably slightly sloping towards the core of the tile but can also be horizontal. The vertically positioned blocking lip is part of the first locking device and has a shape defined to fit into the blocking recess of the first coupling profile to lock the two tiles in the horizontal direction mechanically.

According to a preferred version, the third coupling profile comprises a tooth that preferably runs parallel to the tile's surface.

The back of the tooth preferably has a combination of two recesses and a protrusion that shapes at least one locking device, but preferably two horizontal locking devices. The underside of the tooth preferably has at least partly an upward-sloping flank in the direction of the core of the tile. The tooth is formed at the back by an upward-facing blocking recess that is positioned between the tooth and the protrusion. Preferably, the third coupling profile is equipped with an additional blocking recess that is positioned on the side of the core of the tile between the additional protrusion and the core of the tile.

The tongue is shaped to fit into the recess of the first and second coupling, resulting in a watertight coupling blocked in both the vertical and horizontal directions.

A feature of the current invention is the provision of a rigid waterproof floor or wall cladding tile that offers the possibility of a wide range of visual surface appearances and a rigid and relatively environmentally friendly core. The composite tiles, according to the invention, can advantageously use the first and second coupling profiles interacting as described in the patent so that the floor can be clicked together as a floating floor, using the installation method for floating floors that does not require glue to bond the floor tiles to the subfloor. In addition, most engineering waterproof tile materials may consist of bamboo fibers, wood dust, or cork fibers, essentially byproducts of other flooring manufacturing processes.

A feature of the current invention is the supply of floor or wall cladding tiles with the possibility of a wide range of visual surface appearances and a rigid core. According to the invention, the constructed tiles can advantageously use only the first and second coupling profiles interacting as described in the patent so that the floor can be clicked together like a floating floor in a possible way that two of the four sides are provided with a first coupling profile and the other sides are equipped with the second coupling profile. The floating floor installation method uses no glue to bond the floor tiles to the subfloor. In addition, most of the designed tile materials can be used on wood, plastic, or any other type of material.

By combining the bamboo, wood, or cork dust, or a combination thereof, with high-density polyethylene (HDPE) or polyvinyl chloride (new, recycled, or a mixture thereof), a rigid and inert core is obtained that does not absorb moisture and does not expand or contract, eliminating the formation of peaks and holes.

The present invention also applies to any tile that is a combination of a watertight core and one type of coupling comprising a first coupling profile and a second coupling profile as described in the invention, one in which the coupling can be connected using a tilting movement, but also using a drop lock movement where the result of the coupling can be compared to the coupling of the classic tooth-and-groove couplings where a tooth is only placed in the groove via a tilting movement and the coupling forms a strong connection in both the vertical and horizontal directions.

The present invention also applies to any tile that is a combination of a watertight core, different couplings comprising a first coupling profile, a second coupling profile, and a third coupling profile as described in the invention, where the coupling between the first and second coupling profiles, the coupling between the first and third coupling profiles, and the coupling between the second and third coupling profiles can be connected using a rotational movement, but also using a drop lock movement where the result of the coupling can be compared to the coupling of the classic tooth-and-groove couplings where a tooth is only placed in the groove via a tilting movement and the coupling forms a strong connection in both the vertical and horizontal directions.

According to the invention, the tile system comprises tiles in a parallelogram shape, such as a rectangle or square, for forming both classical and less classical patterns, including herringbone. In a tile system where the shape of the tiles is a diamond-shaped parallelogram, it can form a chevron pattern when joined. The installation of the tile system by connecting these tiles to create a tile cover can be achieved by tilting a lateral tongue of a first tile to be installed inwards into a recess of a second tile already installed, which is usually—but not necessarily—achieved by laying the tile to be installed diagonally downwards to the already installed tile, which locks the first tile and the second tile at least in the vertical direction, but preferably also in the horizontal direction. Due to the parallelogrammatic shape of the tiles, a chevron pattern can be achieved in a relatively simple and efficient way compared to the installation of conventional parquet tiles.

Introducing the innovative tile system, featuring a third coupling profile, and tiles in the shape of a parallelogram. These versatile shapes, such as a rectangle or square, allow for the creation of intricate herringbone patterns. Even in a system where the tiles are parallelogram-shaped rectangles, a herringbone pattern can be effortlessly formed using just one tile with the three couplings.

The multi-purpose tiles, according to the invention, are relatively inexpensive to manufacture and do not require any special skills or training to handle and install. Their easy installation process makes them an attractive choice for DIYers, instilling a sense of confidence and capability in those who do not have experience installing tiles.

The substantially rigid base layer of each tile is at least partially composed of a foamed composite, preferably a closed-cell composite, comprising at least one plastic material and at least one filler, which provides sufficient rigidity and impact strength to the tile as such, including the vulnerable pointed vertexes. This makes this composite ideal for application in parallelogram-shaped tiles to realize a durable and undamaged chevron pattern, even by unskilled persons. Conventional materials, like HDF and MDF, are weaker than the aforementioned foamed composite and will quickly lead to breakage and/or damage of the pointed vertexes, which renders these conventional materials unsuitable to realize chevron or herringbone patterns. Hence, the substantially rigid, preferably closed-cell foam plastic material used as a component of the foamed composite in the base layer provides the tile as such with desired rigidity and robustness, preventing damage, and in particular breakage, of the coupling profiles and/or the pointed vertexes during normal use. An additional advantage of using a foam plastic material is that the presence of closed cells not only leads to improved rigidity and improved impact resistance but also to reduced density and lighter weight in comparison with dimensionally similar non-foam plastic material and in comparison with conventional materials like HDF and MDF. It is imaginable, although commonly less preferred, that the substantially rigid base layer is at least partially made of an open-cell foam plastic material, or a combination of an open-cell foam plastic material and a closed-cell foam plastic material. The rigidity of the composite of the base layer may further be improved by applying a toughening agent, wherein the base layer of closed-cell foam plastic material may contain, for example, approximately 3% to 9% by weight of the toughening agent.

Because the coupling profiles are given a specific shape, the substantially complementary first and second coupling profiles of adjacent tiles can be connected relatively easily, permanently, and efficiently.

According to a preferred version using only the first and second couplings, a tile comprises a first pair of opposite edges comprising a first edge and an opposite second edge, a second pair of opposite edges comprising a third edge and an opposite fourth edge, in which: the first edge and the third edge enclose a first corner, and where the second edge and the fourth edge enclose a second corner opposite to the said first corner, and where the first pair of opposite sides are provided with pairs of opposite first mechanical coupling devices or parts to make the said tiles at least vertically and preferably also horizontally attachable to each other.

In the case of a version where the first and second edges are the longitudinal sides, the lateral tongue of the first coupling profile on the first side of the first tile is preferably applied to the second side of the second tile using a rotation in the recess of the second coupling profile on the second edge of the first tile. The end of the lateral tongue of the first coupling profile preferentially touches the upward flank of the second coupling profile, and the blocking lip of the second coupling profile on the second side is positioned in the blocking recess of the first coupling profile on the first edge of the second tile. This sturdy mechanical coupling prevents the tiles from moving horizontally from each other or towards each other. In addition, the top of the lateral tongue of the first coupling profile at the first edge of the second tile is blocked by the bottom of the upper lip of the second coupling profile at the second edge of the first tile. This mechanical lock prevents the two tiles from moving vertically relative to each other.

In a preferred version of a tile according to the invention, composed of first and second coupling profiles, the first coupling profile comprises a lateral tongue extending in a direction that is preferably parallel to the top of the tile, the lower rear part is closer to the level of the top of the tile than the lower front part of the lateral tongue. There is a blocking recess between the lateral tongue and the core of the tile, where the top of this recess is closer to the top of the tile than the lower back of the lateral tongue and where the second coupling profile contains a recess for the inclusion of at least part of the lateral tongue of the first coupling profile, where an upper lip and a lower lip also determine this recess. The said lower lip features an upwardly protruding blocking lip to block the lateral tongue, with the lateral tongue being designed so that locking occurs by an introductory movement in the blocking recess of the lateral tongue, the first coupling profile.

As a result, the top of the lateral tongue will engage the upper lip, and the blocking lip of the lower lip will be placed in the blocking recess of the lateral tongue, leading to the locking of adjacent tiles on the first and second edges in both horizontal and vertical directions.

At the first and second edges, a horizontal locking between two tiles has been made by the upwardly projecting blocking lip, which prevents the lower part of the lateral tongue from being moved horizontally about the complementary recess (female part), and the upwardly projecting blocking lip.

Preferably, the blocking lip has an almost flat top. The top face of the blocking lip is mostly horizontally oriented but preferably at least partially beveled so that this top face is oriented away from the upper lip in the direction of the core of the tile.

The side wall of the blocking lip facing the tile core is preferably sufficiently inclined (steep) to act as a closing surface for blocking connected tiles in a horizontal direction.

The blocking lip wall can be flat but is preferably curved to slightly curved because a curved blocking lip wall facilitates the insertion of the blocking lip of the second coupling profile of the first tile into the blocking recess of the first coupling profile of the second tile.

The upper part of the lower lip extending between the core and the blocking lip may be straight, may be partially curved (rounded) but also irregular in shape, with the shape of the upper part of the lower lip preferably being significantly complementary to the shape of the at least partially lower part of the lateral tongue.

The complementary surfaces act as sliding surfaces during the coupling of the tiles. The upper surface preferably has a substantially complementary shape to a corresponding upper part of the lower lip.

A vertical blocking of the first coupling profile on the second tile on the second coupling profile of the first tile is brought to the stage by engaging a top surface of the lateral tongue, with a lower surface of the upper lip of the second coupling profile acting as the blocking surface.

In fact, the upper lip prevents the lateral tongue from being moved in a vertical direction. After pairing, an upper part of the lateral tongue preferably partially engages a lower part of the upper lip.

After coupling, the preferably horizontal upper surface of the lateral tongue corresponds to the entire lower surface of the upper lip. This partial or complete switch-on prevents play between linked tiles. For example, the first edge of the first tile and the second edge of the second tile can be connected without any gap.

Because the coupling profiles are given a specific shape, the substantially complementary first and second coupling profiles on the first and second edges of the tile, respectively, and the substantially complementary first and second coupling profiles of adjacent tiles on the third and fourth edges, respectively, can be connected relatively quickly, but permanently and efficiently.

When coupling an adjacent tile to the fourth edge of the second tile, the lateral tongue of the first coupling profile of the third edge will exert a force on the top of the blocking lip of the second coupling profile of the fourth edge of the adjacent tile via a scissoring movement.

This pushes the blocking lip downwards, causing the lower lip of the second coupling profile to deform slightly and temporarily (springy), mainly around the spring point that forms the transition between the core of the tile and the lower lip. This increases the opening of the recess of the second coupling profile.

During this scissoring movement, the top of the blocking lip exerts a force on the angled bottom of the lateral tongue of the first coupling profile of the third edge, which pushes the lateral tongue horizontally into the recess of the second coupling profile. As a result, at least part of the end of the first coupling profile exerts a force on at least part of the end of the second coupling profile.

In a position where the tile of the first coupling profile is not parallel longitudinally to the tile of the receiving second coupling profile, at least part of the end of the first coupling profile will exert pressure on a shared contact surface between the two couplings.

Once the lateral tongue is almost wholly positioned horizontally, the lateral tongue is pushed horizontally towards the recess of the second coupling profile by a combination of downward pressure of the lateral tongue on the blocking lip of the lower lip of the second coupling profile, which is converted horizontally towards the recess of the second coupling profile by force exerted by the blocking lip on the underside of the lateral tongue.

In this movement, the top of the lateral tongue is placed under the lower surface of the upper lip of the second coupling, blocking the lateral tongue vertically.

Once the lateral tongue of the first coupling profile has been positioned in the recess of the second coupling profile, the forced lower lip springs back to its initial position. As a result, the blocking lip of the second coupling profile is positioned in the blocking recess of the first coupling, so the lateral tongue is clamped in the recess of the second coupling profile, and the two couplings are blocked horizontally in relation to each other.

By clamping the lateral tongue in the recess of the second coupling with a spring-loaded lower lip, a reliable, locked coupling is achieved between the first and second coupling profiles and, thus, between the two adjacent tiles.

Therefore, the second coupling profile can be considered a substantially rigid coupling profile with limited resilience to allow coupling. Due to the stiffness of the base layer and the fact that at least some of the coupling parts will typically be integrated with that base layer (at least in some versions), the resilience of the coupling parts will generally be very limited, although sufficient to be able to connect and disconnect tiles.

In an additional preferred version of the first coupling profile, according to the invention, the top of the lateral tongue of the first coupling profile is straight and horizontal, but it may also be slightly beveled towards the core of the tile or away from the direction of the core. This surface may be curved or even irregular in shape, but preferably at least partially the same shape as the lower surface of the upper lip.

In the first coupling profile, the flank connecting the top of the lateral tongue to the bottom of the lateral tongue is preferably straight in shape. It preferably forms an angle of 45° to the flank on the end of the lateral tongue, but this angle can also be different, but preferably limited to a range between 0° and 65°.

If it is desired that the connection between the two adjacent tiles forms a niche, the angle of the flank that forms the connection between the top of the tile and the top of the lateral tongue is preferably 45°, but it can also be different; here, it is indicated that the corresponding edges on the different sides of the different tiles are all placed at the same angles. If the surfaces of the two tiles are to be connected almost seamlessly, the angle of the flank is preferably 90°.

The flank from the end of the lateral tongue is preferably straight and vertical but can also be oblique, with the top of the flank being closer to the core of the tile than the bottom of the flank. The flank may also be curved in shape or have another irregular shape, but preferably at least partially the same shape as the upward flank of the end of the coupling profile of the connected tile.

The shape of the transition between the end of the lateral tongue and the bottom of the lateral tongue is preferably a sharp angle. It can also be beveled, where the sloping surface preferably has an angle of 45° to the tile's surface but can also be rounded or irregular.

The bottom of the lateral tongue is beveled, with the lower rear part being closer to the level of the top of the tile than the lower front part. The angle between the horizontal plane and the plane of the bottom is preferably between 10° and 45°, but not less than 10° and at least 5°. The larger the angle of this plane, the better the torque effect. The inclination of this angle depends to a large extent on the thickness of the tile. The general thesis is that the thicker the tile, the larger the angle can be. The preferred angle for thicker tiles is between 30° and 60° with a maximum of 80°. The shape of the bottom is preferably flat or slightly curved to ensure smooth operation. However, it can also be stepped or irregular in general shape, but preferably at least partially the same shape as the top of the lower lip of the second coupling profile.

The blocking recess is between the lateral tongue and the core of the tile of the first coupling profile. The top of this recess is preferably flat and horizontally oriented. It may also be rounded or irregular in shape, but preferably at least partially the same shape as the top of the blocking lip of the second coupling profile if they touch each other in the coupled state.

The downward edge on the lateral tongue that forms the connection between the top of the blocking recess and the bottom of the lateral tongue is preferably flat and vertical and shorter than the opposite side flank on the side of the core of the tile.

The transition between the underside of the lateral tongue and the downward flank of the lateral tongue is preferably an obtuse angle but can also be rounded or beveled.

The downward-facing side flank in the blocking recess on the side of the core of the tile that forms the connection between the top of the blocking recess and the bottom of the tile is preferably flat, vertical, and longer than the opposite side flank.

The distance between the two downward-facing side flanks of the blocking recess of the first coupling profile is preferably 0.1 mm greater than the distance between the two vertical flanks of the corresponding blocking pin of the second coupling profile. This distance can be more significant, but preferably a maximum of 0.2 mm to 0.3 mm. The distance can also be smaller but preferably greater than 0 mm.

In an additional preferred version of the second coupling profile, according to the invention, the gap between the lower lip and the upper lip forms the recess into which the lateral tongue of the first coupling profile fits.

The lower surface of the upper lip of the second coupling profile is preferably slightly sloping towards the core of the tile but can also be parallel to the surface of the tile and is preferably flat in shape. The shape can also be stepped or irregular, but it is preferably at least partially similar to the top of the lateral tongue of the first coupling profile.

The upright flank at the end is preferably point-shaped, with the point shape formed by two oblique, preferably flat sides. The upper chamfer adjacent to the surface preferably has an angle of 45° and is preferably equal to the chamfer side of the first coupling profile of the adjacent tile.

The lower chamfer of the point shape is adjacent to the underside of the upper lip and preferably has an angle of 45° to the surface of the tile. This surface is preferably flat but may also be stepped or irregular in shape, but preferably at least partially similar in shape and/or angle to the sloping side of the lateral tongue of the first coupling profile adjacent to the top of the tile.

The upward flank in the recess between the upper and lower lip of the second coupling profile on the side of the core of the tile forms the connection between the lower surface of the upper lip and the upper part of the lower lip and is preferably placed vertically. This surface is preferably flat but may also be stepped or irregular. It is preferably at least partially the same shape and/or angle as the end of the lateral tongue of the first coupling.

The transition between the lower surface of the upper lip and the upward flank can be a right angle but is preferably beveled, with the sloping surface preferably having an angle of 45° to the surface of the tile. The beveled side preferably has the same angle as the beveled part of the surface between the top of the lateral tongue and the top surface of the tile of the first coupling profile and therefore also the same angle as the lower bevel of the pointed upper lip of the second coupling profile. The shape of this surface may also generally be rounded or irregular, but preferably at least partially similar in shape and/or angle to the end face of the lateral tongue of the first coupling profile.

The lower lip forms the bottom of the cutout and borders the upward flank on the side of the tile's core. The transition between the upward flank and the upper part of the lower lip is preferably at a sharp angle. Still, it can also be beveled, where the slanted surface preferably has an angle of 45° to the tile's surface and is rounded or even irregular in shape. This transition should preferably be at least partially the same as the transition from the end to the bottom of the lateral tongue of the first coupling profile.

The top of the lower lip of the second coupling profile should preferably be of a straight shape and preferably at least partially arranged at the same angle as the corresponding bottom of the lateral tongue of the first coupling. This upper side should be the same as the corresponding underside of the lateral tongue of the first coupling profile.

The bottom of the second coupling profile's lower lip is preferably straight and parallel to the top of the lower lip. This arrangement forms an open space between the virtual line that extends the bottom of the tile and the bottom of the lower lip.

The blocking lip is at the end of the lower lip, on the side furthest from the core of the tile. The blocking lip is vertically oriented and preferably comprises two upward flanks and a top.

The upward flank on the side of the core of the tile is preferably vertically oriented and straight in shape. The junction of the upward flank and the top of the lower lip is preferably at an obtuse angle but can also be rounded or beveled.

This junction should be partially identical to the corresponding junction between the underside and the end edge of the lateral tongue of the first coupling profile.

The end flank at the end of the lower lip is preferably vertically oriented and straight in shape. The transition of the upward flank and the bottom of the lower lip is preferably an obtuse angle but can also be rounded or beveled.

The top of the blocking lip is preferably horizontally oriented and straight in shape, with the angle on the side of the core of the tile preferably beveled. The angle of this chamfer is preferably 45°. The difference between the angle of the chamfer of this beveled surface and the underside of the lateral tongue is preferably a minimum of 10° and a maximum of 50°, ideally 30°, but not less than 0°.

Advantages of the Invention

In the versions where the first and second types of coupling profiles are used, which are applied to the four sides of a tile, it is possible to form many more patterns than the classic couplings. Since the combination of the first and second coupling profiles can be used as both drop-lock and tilt-based coupling, the end sides of the tile can also be connected to the longitudinal sides of the adjacent tile as long as a combination of the first and second coupling profiles is formed.

In the versions where the first, second, and third types of coupling profiles are used, which are applied to the four sides of a tile, it is possible to form many more patterns than the classic couplings. This setup makes creating a herringbone pattern with just one plank type possible.

Another advantage is that production is easier because you are only limited to two sets of tools for forming the couplings.

Another advantage is that the coupling carried out according to this invention cannot come loose in horizontal and vertical directions, even if it is used as a drop-lock connection, preventing the so-called lipping.

In a second type of version, three types of couplings are used, in which the embodiment of the first coupling profile is essentially the same in structure as in the version in which only a first and second type of coupling profile is used. The embodiment of the second coupling profile is almost the same in structure as in the version in which only a first and second type of coupling profile is used and the third coupling profile is a hybrid version, an embodiment of which can be seen in FIG. 14, and can be coupled to the first coupling profile and second coupling profile as defined in the version where only a first and second type of coupling profile is used.

Because the coupling profiles are given a specific shape, the substantially complementary first and second coupling profiles, the first and third coupling profiles, and the adjacent tiles' second and third coupling profiles can be connected relatively quickly, but permanently and efficiently.

According to a preferred version using the first, second, and third coupling profiles, a tile comprises a first pair of opposite edges consisting of a first edge and an opposite second edge; a second pair of opposite edges consisting of a third edge and an opposite fourth edge, in which: the first edge and the third edge enclose a first corner, and where the second edge and the fourth edge enclose a second corner opposite to the said first corner, and where the first pair of opposite sides are provided with pairs of opposite first mechanical coupling devices to make the said tiles at least vertically and preferably also horizontally attachable to each other.

In a preferred version, the first edge is provided with a first coupling profile, the second edge with the second coupling profile, and the third and fourth edges with the third coupling profile.

This version makes it possible to form the so-called herringbone patterns with just one tile form.

In the case of a version where the first and second edges are the longitudinal sides, the lateral tongue of the first coupling profile on the second tile is preferably applied to the second edge using a rotation in the recess of the second coupling profile of the first edge.

The head side of the lateral tongue of the first coupling profile preferentially touches the upward flank of the second coupling profile, and the blocking lip of the second coupling profile on the second side is positioned in the blocking recess of the first coupling profile on the second edge of the first tile. This sturdy mechanical coupling prevents the tiles from moving horizontally from each other or towards each other. In addition, at least part of the chamfer of the lateral tongue of the first coupling profile at the first edge on the second tile is blocked by at least part of the chamfer or the upper lip of the second coupling profile at the second edge of the first tile. This mechanical lock prevents the two tiles from moving vertically relative to each other.

A preferred version of a tile, according to the invention, is composed of first, second, and third coupling profiles. The first coupling profile comprises a lateral tongue extending in a direction essentially parallel to the top of the tile, with the lower front part of the lateral tongue configured as a blocking device. In comparison, the lower rear part of the tongue is configured as a blocking means, where the lower rear part is closer to the level of the top of the tile than the lower part of the lower front part, and where the second coupling profile contains a recess for including at least part of the lateral tongue of the first coupling profile, determined by an upper lip and a lower lip. The said lower lip features an upwardly protruding blocking lip to block the lateral tongue, with the lateral tongue designed so that locking occurs by an introductory movement into the blocking recess of the lateral tongue.

The lateral tongue of the first profile recess is provided with an additional recess that makes it possible to receive at least part of the lateral tongue of the third coupling profile. This recess of the lateral tongue means the lateral tongue also has an upper and lower lip.

When applying the lateral tongue of the first coupling profile of the second tile to the second side of the first tile using a rotation in the recess of the second coupling profile of the second edge, the chamfer of the upper lip of the lateral tongue of the first coupling profile will engage the upper lip of the chamfer of the upper lip of the recess of the second coupling profile and/or the top or middle lip of the lateral tongue will push against the top of the recess positioned on the side of the second tile and the blocking lip of the lower lip of the second coupling profile will be placed in the blocking recess of the lateral tongue of the first coupling profile, which leads to locking of adjacent tiles on the first and second edges in both horizontal and vertical directions.

At the first and second edges of the adjacent tiles, a horizontal blocking between the two tiles is brought to bear by the presence of the upwardly projecting blocking lip, which prevents the lower part of the lateral tongue (male part) from being moved horizontally about the complementary recess (female part) and the upwardly projecting blocking lip.

Therefore, the blocking lip locks the bottom of the lateral tongue in place.

Preferably, the blocking lip of the first coupling profile should have an almost flat top. The upper surface of the blocking lip is primarily oriented horizontally but preferably at least partially beveled, so this upper face is oriented away from the upper lip.

The side wall of the blocking lip of the first coupling profile facing the tile core is preferably sufficiently inclined (steep) to act as a closing surface for blocking connected tiles in a horizontal direction.

The blocking lip wall can be flat but is preferably curved to slightly curved because a curved blocking lip wall facilitates the positioning of a lateral tongue of a second tile in the recess of the second edge of a first tile.

The upper part of the lower lip of the second coupling profile extending between the core and the blocking lip may be straight, partially curved (rounded), or irregular in shape, with the shape of the upper part of the lower lip preferably being significantly complementary to the shape of at least part of the lower part of the lateral tongue of the first coupling profile.

The complementary surfaces act as sliding surfaces during the coupling of the tiles. The upper surface of the lower lip of the second coupling profile preferably has a substantially complementary shape to a corresponding upper part of the lower lip.

A vertical blocking on the first and second edges of two coupled tiles is brought to the fore by having the first coupling profile perform a locked function by clamping part of the upper lip of the lateral tongue of the first coupling profile of the second tile behind part of the upper lip of the second coupling profile on the first tile.

In this configuration, the upper lip of the second coupling profile prevents the lateral tongue of the first coupling profile from being moved vertically if the first coupling is positioned in the second coupling. When coupling, part of the upper lip of the lateral tongue of the first coupling profile preferably at least partially engages with a lower part of the upper lip of the second coupling profile.

After coupling, the preferably horizontal upper surface of the lateral tongue of the first coupling profile corresponds to the entire lower face of the upper lip of the second coupling profile. This partial or complete engagement prevents play between linked tiles. For example, the two edges of the first tile and the first edge of the second tile can be connected without any gaps.

Because the coupling profiles are given a specific shape, the substantially complementary first and second coupling profiles can be connected relatively easily on the second and first edges of the tile edge, respectively, but permanently and efficiently.

In an additional preferred version of the first coupling profile according to the invention, the lateral tongue of the first coupling profile is provided with an additional recess to provide the first coupling profile with an upper lip and lower lip. The upper lip is preferably provided with a chamfer starting from the top surface and sloping down to the end of the tile. The angle of this bevel may have an angle between 25° and 65°, but preferably between 35° and 55°, most preferably an angle of 45°.

If it is desired that a groove is formed between two tiles, it is recommended that a bevel be provided on both tiles. This bevel may have an angle between 25° and 65°, but preferably between 35° and 55°, most preferably an angle of 45°. If the surfaces of the two tiles are to be connected almost seamlessly, the angle of the flank is preferably 90°.

The end of the upper lip of the first coupling profile is preferably vertical and straight in shape but can also be oblique, curved, or even irregular in shape. On the lower part of the end side, an extra sloping surface is preferably provided with the top of the sloping surface starting at the end and sloping away from the core of the tile. This bevel should preferably have the same shape and angle as the lower bevel of the upper lip of the second coupling profile.

The flank at the end of the lateral tongue of the first coupling profile is preferably straight and vertical but may also have at least one chamfered corner. This flank may also be curved in shape or take on another irregular shape, but preferably at least partially the same shape as the internal upward flank of the second coupling profile.

The underside of the lateral tongue of the first coupling profile is preferably partially beveled, with the lower rear part of the chamfered part being closer to the level of the top of the tile than the lower part of the lower front part. The angle between the horizontal plane and the plane of the bottom is preferably between 10° and 45°, but not less than 5°. The larger the angle of this plane, the better the effect. The inclination of this angle depends largely on the thickness of the tile. The general thesis is that the thicker the tile, the larger the angle can be. The preferred angle for thicker tiles is between 30° and 60° with a maximum of 80°. The shape of the bottom is preferably flat or slightly curved to ensure smooth operation. However, it can also be stepped or irregular in general shape, but preferably at least partially the same shape as the top of the lower lip of the second coupling profile.

The blocking recess is between the lateral tongue and the core of the tile of the first coupling profile. The top of this recess is preferably flat and horizontally oriented but can also be rounded or irregular in shape, but preferably at least partially the same shape as the top of the blocking lip of the second coupling profile.

The downward edge on the lateral tongue forms the connection between the top of the blocking recess and the bottom of the lateral tongue. This side flank is preferably slightly sloping and flat in shape but can also be set up vertically and is shorter than the opposite side flank on the side of the core of the tile.

The transition between the underside and the downward flank of the lateral tongue is preferably an obtuse angle but can also be rounded or beveled.

The downward-facing side flank on the side of the tile core forms the connection between the top of the block recess and the bottom of the tile. This side flank is preferably flat and vertical and longer than the opposite side flank.

The distance between the two downward-facing side flanks of the blocking recess of the first coupling profile is preferably 0.1 mm greater than the distance between the two vertical flanks of the corresponding blocking pin. This distance can be more significant, but preferably a maximum of 0.2 mm to 0.3 mm. It can also be smaller but preferably larger than 0 mm.

The recess forms the upper and lower lip in the lateral tongue of the first coupling profile. This recess can receive at least part of the tooth of the third coupling profile and is made up of the top, which is the bottom of the top lip of the first coupling profile. This top is preferably flat and horizontal but can also be slightly sloping towards the core of the tile. The upright flank on the side of the core of the tile is preferably arranged vertically and possibly provided with a partly chamfered side at the bottom of the flank. The bottom of the recess is preferably flat in shape and horizontal and preferably parallel to the underside of the lateral tongue.

The upright flank inside the recess, which also forms the lower lip of the lateral tongue, is preferably straight and slightly oblique and sloping towards the core of the tile. However, it can also be set up vertically, curved, or even irregular.

In an additional preferred version of the second coupling profile, according to the invention, the gap between the lower lip and the upper lip forms the recess into which the lateral tongue of the first coupling profile fits.

The lower surface of the upper lip should be at least parallel to the surface of the tile but preferably sloping towards the core of the tile and should preferably be flat in shape. However, it can also be stepped or irregular in general shape, but preferably at least partially the same shape as the top of the lateral tongue of the first coupling.

The upright side on the side of the niche is preferably point-shaped, with the point shape formed by two angled, preferably flat sides. The upper chamfer adjacent to the surface preferably has an angle of 45° and/or is preferably equal to the chamfer side of the adjoining coupling profile.

The lower chamfer of the point shape is adjacent to the underside of the upper lip and preferably has an angle of 45° to the surface of the tile. This surface is preferably flat but can also be stepped or irregular. It is preferably at least partially the same shape and/or angle as the bevel of the lateral tongue of the coupled first coupling profile adjacent to the top of the tile.

The upward flank on the side of the core of the tile forms the connection between the lower surface of the upper lip and the upper part of the lower lip, which is preferably positioned vertically. This surface is preferably flat but may also be stepped or irregular in shape and/or provided with one or more chamfered or rounded surfaces, but preferably at least partially the same shape and/or angle as the end face of the lateral tongue of the first coupling and/or the third coupling.

The top of the lower lip of the second coupling profile should preferably have a straight shape and preferably have at least partially the same shape as the corresponding underside of the lateral tongue of the first coupling profile and/or third coupling profile. At least the shape of the top of the lower lip allows both the lateral tongue of the first coupling profile and the tooth of the third coupling profile to be easily inserted on both coupling modes.

The bottom of the second coupling profile's lower lip is preferably straight and parallel to the top of the lower lip. Partly because of this, an open space is created between the virtual line aligned with the bottom of the tile and the bottom of the lower lip for at least part of the length of the lower lip.

At the end of the lower lip is the blocking lip. The blocking lip is vertically oriented and comprises two upward flanks and a top.

The upward flank on the side of the core of the tile is preferably straight in shape and slightly sloping down to the core of the tile but can also be set up vertically. The wall may also be rounded, but it can also be stepped and even irregular in shape.

This upward edge is preferably at least partially equal to the corresponding edge of the first and/or third coupling profiles.

The upward flank at the end of the lower lip is preferably vertically oriented and straight in shape. The transition of the upward flank and the bottom of the lower lip is preferably an obtuse angle but can also be rounded or beveled.

The top of the blocking lip is preferably horizontally oriented and straight in shape, with the corner on the side of the core of the tile preferably beveled. The angle of this chamfer is preferably 45°. The difference between the angle of the chamfer between this beveled surface and the underside of the lateral tongue is preferably a minimum of 10° and a maximum of 50°, ideally 30°, but not less than 0°.

The transition between the core of the tile and the lower lip is preferably narrower than the thickness of the lower lip itself. This transition forms the spring point that gives the lower lip its springy effect to a large extent while the blocking lip is actively pushed downwards.

A preferred version of a tile, according to the invention, is composed of first, second, and third coupling profiles; the third coupling profile comprises a lateral tooth extending in a direction essentially parallel to the top of the tile, with the tooth of the lateral tongue configured as a blocking device. The third coupling profile can be connected to both the first and second coupling profiles. For this purpose, it is equipped with two blocking recesses. A first blocking recess is a recess in the third coupling profile positioned closest to the core of the tile. The second blocking recess is a recess in the third coupling profile between the tooth and the first blocking recess. When connecting the third coupling profile to the second coupling profile, the blocking lip of the second coupling profile will position itself in the first blocking recess of the third coupling profile. When connecting the third coupling profile to the first coupling profile, the blocking lip of the first coupling profile will position itself in the second blocking recess of the third coupling profile.

The separation between the first blocking and second blocking recess is formed by an intermediate profile in which the lower rear part of the intermediate profile, which is closer to the core of the tile, is closer to the level of the top of the tile than the front lower part of the intermediate profile.

The first blocking recess is formed by an upward flank on the side of the core of the tile that is preferably straight in shape and arranged vertically. This flank preferably extends from the bottom of the tile to the top of the first blocking recess. The top of the first blocking recess should preferably be horizontally parallel to the top surface of the tile and preferably have at least the same shape as the top of the blocking lip of the second coupling profile. The shape and arrangement of the top must allow the blocking lip of the second coupling profile to have sufficient space to take place in the space of the first blocking recess. The flank on the side of the tooth is preferably slightly slanted, sloping in the direction of the tooth. This flank extends from the top side of the first blocking recess to the lower sides of the intermediate profile.

An upward flank on the side of the intermediate profile forms the second blocking recess. It is preferably straight in shape and slightly slanted, sloping toward the intermediate profile. This flank preferably extends from the bottom of the intermediate section to the top of the second blocking recess. The top of the second blocking recess should preferably be horizontally arranged parallel to the top surface of the tile and preferably have at least the same shape as the top of the blocking lip of the second coupling profile. The shape and arrangement of the top must allow the blocking lip of the first coupling profile to have sufficient space to take place in the space of the second blocking recess. The flank on the side of the tooth is preferably slightly slanted, sloping in the direction of the tooth. This flank extends from the top of the second blocking recess to the bottom of the tooth of the third coupling profile.

The underside of the tooth of the third coupling profile is preferably flat in shape and at least partly provided with a sloping surface ascending towards the core of the tile. This underside connects the tooth's end with the second blocking recess flank.

The flank of the end of the tooth is preferably straight in shape and vertical. The lower part of the flank of the end side, which forms an angle in combination with the bottom of the tooth, is preferably rounded or chamfered to facilitate the access of the tooth into the receiving recesses of the first and second coupling profiles. Preferably, the upper part of the flank of the end side, which forms an angle in combination with the top of the tooth, is preferably rounded or chamfered to facilitate the access of the tooth into the receiving recesses of the first and second coupling profiles.

The top of the tooth is preferably flat and horizontal but can also be slanted, rounded, stepped, or even irregular in shape. The shape of the upper surface shall preferably be at least partly the same as the shape of the corresponding lower surface of the upper lip of the first coupling profile and/or at least partly the shape of the corresponding lower surface of the upper lip of the second coupling profile.

The flank of the end of the third coupling profile should be straight in shape and vertical, with the shape of this flank at least partly corresponding to the end of the corresponding end edges of the first and/or second coupling profiles. The lower part of the flank of the end side, which forms an angle in combination with the bottom of the tooth, is preferably rounded or chamfered to accommodate the protruding part at the bottom of the end flank of the first coupling profile and thus make it possible to create a smooth coupling with the first coupling profile. Preferably, the upper part of the flank of the end side, which forms an angle in combination with the top of the tile, is preferably beveled, with the shape and angle identical to the corresponding chamfered edges of the first and second coupling profiles.

With this version, it is possible to apply the tooth of the third coupling profile on, for example, the third edge of the second tile, on both the first coupling profile on the first edge of the first tile and the second coupling profile on the second edge of the second tile using a pushing movement or a rotating movement.

When inserting the third coupling profile into the second coupling profile using a pushing movement or a rotation in the recess of the second coupling profile, at least part of the top of the tooth of the third coupling profile will touch at least part of the bottom of the upper lip of the second coupling profile in a hooked function. This causes the third and second couplings to be blocked in the vertical direction. Preferably, in this position, the front flank of the third coupling should be pressed at least partly against the end of the second coupling. This is to form a first buffer to make the coupling watertight. The bottom of the profile of the third coupling profile preferably touches at least part of the top of the lower lip of the second coupling profile, with the first flank of the blocking recess of the third coupling profile at least partially touching the inside flank of the blocking lip of the second coupling profile. The blocking lip of the second coupling profile is positioned in the first blocking recess of the third coupling profile, ensuring that the second and third coupling profiles cannot move relative to each other in a horizontal direction.

When inserting the third coupling profile into the first coupling profile using a pushing movement or a rotation in the recess of the first coupling profile, at least part of the top of the tooth of the third coupling profile will touch at least part of the bottom of the upper lip of the first coupling profile in a hooked position. This causes the third and first coupling to be blocked in the vertical direction. Preferably, in this position, the front flank of the third coupling is at least partly pressed against the end of the first coupling. This is to form a first buffer to make the coupling watertight. The bottom of the tooth of the third coupling profile preferably touches at least part of the top of the lower lip of the first coupling profile, with the second flank of the second blocking recess of the third coupling profile at least partially touching the inside flank of the blocking lip of the first coupling profile. The blocking lip of the first coupling profile is positioned in the second blocking recess of the third coupling profile, ensuring that the first and third coupling profiles cannot move relative to each other in a horizontal direction.

Because the coupling profiles are given a specific shape, the substantially complementary first and third coupling profiles and the second and third coupling profiles can be connected relatively easily but permanently and efficiently.

Advantages of the Invention

The couplings described in the invention can be applied to the four sides of a tile, allowing for many more configurations. For example, the end and longitudinal sides can be connected on any basis, with the option to connect them via a rolling or drop lock movement.

In the most common version of tile connection, the first coupling profile can be provided on two adjacent sides at the top of the tile, and the second coupling profile can be provided on the other two sides at the bottom.

Another advantage is that production is easier because only limited to two sets of tools are needed for forming the couplings, which can be applied to both the end and the longitudinal sides.

Another advantage is that the coupling carried out according to this invention cannot come loose in horizontal and vertical directions, even if it is used as a drop lock connection, preventing the so-called lipping.

To make a herringbone profile with the tiles, a first, second, and third coupling profile is provided, whereby a first coupling profile is supplied on the first edge of the tile, and a second coupling profile is provided on the second edge. A subsequent arrangement is possible with a third coupling profile on the ends of the tile on both the third and fourth edges. A first tile is connected at its third edge to a part of the second edge of a second tile, with the third edge of the second tile being an extension of the second edge of the first tile.

The first edge of a third tile is connected to part of the second edge of the first tile and the third edge of the second tile. The second edge of a fourth tile is linked to the third side of the third tile and the first edge of the second tile. In this way, the floor can be further built according to a herringbone pattern.

If the first, second, and fourth tiles are already connected, where the third edge of the first tile is connected to the second edge of the second tile, where the first edge of the third tile is connected to the third edge of the second tile and the second edge of the first tile, and where the first edge of the second tile is connected to the second edge of the fourth tile, with the coupling offset by a length equal to the width of the third or fourth edge of the first tile in the direction of the first edge of the first tile, then, when applying the tooth of the first coupling profile of the third tile into a part of the second coupling profile on the second edge of the first tile and the third coupling profile of the third edge of the second coupling profile via the third coupling profile on the third edge of the third tile is applied to the top of the blocking lip of the second coupling profile on the second edge of the adjacent fourth tile using a scissoring movement.

As a result, the blocking lip of the second coupling profile of the fourth tile is pushed downwards, causing the lower lip of the second coupling profile to deform slightly and temporarily (springy), mainly around the spring point that forms the transition between the [entire] core of the tile and the lower lip. This increases the opening of the recess of the second coupling profile.

During this scissoring movement, the top of the blocking lip exerts a force on the angled bottom of the third coupling profile, pushing the tooth into the recess of the second coupling profile once the third tile reaches a quasi-horizontal position.

As a result, at least part of the end of the first coupling profile exerts a force on at least part of the end of the second coupling profile.

In a position where the tile with the first coupling profile is not parallel longitudinally to the tile with the receiving second coupling profile, at least part of the end plane of the first coupling profile exerts pressure on a shared contact surface between the two couplings.

Once the tooth is positioned almost horizontally, the tooth of the third coupling profile of the first tile is pushed horizontally in the direction of the recess of the second coupling profile of the fourth tile by the downward pressure of the tooth on the blocking lip of the lower lip, which is converted horizontally in the direction of the recess of the second coupling profile by force exerted by the force of the blocking lip on the bottom of the tooth of the third coupling.

In this movement, the top of the tooth of the third coupling profile is placed under the lower surface of the upper lip of the second coupling, blocking the tooth of the third coupling profile in a vertical direction.

Once at least part of the end of the tooth touches at least part of the upward flank of the second coupling, the forced lower lip springs the second coupling profile back to its starting position. As a result, the blocking lip of the second coupling profile is positioned in the first blocking recess of the third coupling profile. Thus, the tooth is clamped in the recess of the second coupling profile and blocked horizontally.

By clamping the tooth in the recess of the second coupling profile with a spring-loaded lower lip, a reliable, locked coupling is achieved between the third and second coupling profiles and, thus, between the two adjacent tiles.

Therefore, the second coupling profile can be considered a substantially rigid coupling profile with limited resilience to allow coupling. Due to the stiffness of the base layer and the fact that at least some of the coupling parts will typically be integrated with that base layer (at least in some versions), the resilience of the coupling parts will generally be very limited, although sufficient to be able to connect and disconnect tiles.

With the classic drop lock, you can't be sure the two couplings are correctly assembled. As a result, it sometimes happens that the couplings are pushed or knocked when connecting the two tiles if they are equipped with the usual drop lock connections. In the case of the coupling according to the current invention, this is virtually impossible because the first coupling, when used as a drop lock coupling, slides into the second coupling profile when compressed, forming a similar coupling to the well-known tooth-groove tilt couplings.

Moreover, tools such as a hammer are no longer needed to press the two tiles together; this is still possible with tooling but is, in principle, not necessary.

The advantage of using the foamed composite of the base layer is that this composite has waterproof properties, making the tiles suitable for both indoor and outdoor use.

This locked coupling, wherein both coupling parts mutually engage in a relatively reliable manner and which commonly results in a locking effect between two tiles both in the horizontal direction and in the vertical direction, will preferably be without play, which counteracts the risk of the occurrence of creaking noises. At this moment, it aims to reduce this risk by a suitable design of the profiles of the coupling parts, such that the risk of said undesired noises is decreased even if no sliding agent is applied, which, however, does not exclude that a sliding agent still can be used on the coupling parts of the tiles according to the invention.

Conventional HDF/MDF absorbs water and will further weaken during wetting, which will further decrease the rigidity of the tiles and, in particular, the rigidity of the (even more) vulnerable pointed vertexes. An additional property of the foamed composite is the relatively low density compared to conventional materials, leading to lightweight tiles, which is not only advantageous from an economic point of view but also expands the applicability of the floor system according to the invention, for example, in or on aircraft, vehicles, and vessels, in particular ships. According to the invention, the tile system can thus be used for different purposes. Typically, the lightweight multi-purpose tiles are used to realize a ceiling covering, a wall covering, and/or a floor covering, or, for example, as a covering of a piece of furniture.

According to the invention, the tiles of the tile system may also be referred to as panels. The base layer may also be referred to as the core layer. The coupling profiles may also be referred to as coupling parts or as connecting profiles. By "complementary" coupling profiles it is meant that these coupling profiles can cooperate with each other. However, to this end, the complementary coupling profiles do not necessarily have to have perfectly complementary forms. By locking in the "vertical direction" is meant locking in a direction perpendicular to the plane of the tile. By locking in the "horizontal direction" is meant locking in a direction perpendicular to the respective coupled edges of two tiles and parallel to or coinciding with the plane defined by the tiles. In case in this document reference is made to a "floor tile" or "floor panel," these expressions may be replaced by expressions like "tile," "wall tile," "ceiling tile," or "covering tile." In the context of this document, the expressions "foamed composite" and "foamed plastic material" (or "foam plastic material") are interchangeable, wherein in fact the foamed composite comprises a foamed mixture comprising at least one (thermo)plastic material and at least one filler. Typically, the plastic material technically allows the foam to be formed, so the formed foam as such is formed by a foam matrix comprising both at least one (thermo)plastic material and at least one filler.

When achieving a herringbone or chevron pattern, it is advantageous if the system comprises two different types of tiles (A and B, respectively), where the first mechanical coupling means of one type of tile are arranged along the first pair of opposite edges in a mirror-like inverse manner with respect to the corresponding first mechanical coupling along the same first pair of opposite edge sides of the other type of tile.

Each tile preferably comprises an upper substrate affixed to an upper side of the base layer, wherein said substrate preferably comprises a decorative layer. The upper substrate is preferably at least partially made of at least one material selected from the group comprising metals, alloys, macromolecular materials such as vinyl monomer copolymers and/or homopolymers; condensation polymers such as polyesters, polyamides, polyimides, epoxy resins, phenol-formaldehyde resins, and urea-formaldehyde resins; natural macromolecular materials or modified derivatives thereof such as plant fibers, animal fibers, mineral fibers, ceramic fibers, and carbon fibers. Here, the vinyl monomer copolymers and/or homopolymers are preferably selected from the group comprising polyethylene, polyvinyl chloride (PVC), polystyrene, polymethacrylates, polyacrylates, polyacrylamides, ABS (acrylonitrile-butadiene-styrene) copolymers, polypropylene, ethylene-propylene copolymers, polyvinylidene chloride, polytetrafluoroethylene, polyvinylidene fluoride, hexafluoropropene, and styrene-maleic anhydride copolymers, and derivatives thereof. The upper substrate most preferably comprises polyethylene or polyvinyl chloride (PVC). The polyethylene can be low-density polyethylene, medium-density polyethylene, high-density polyethylene, or ultra-high-density polyethylene. The upper substrate layer can also include filler materials and other additives that improve the physical properties and/or chemical properties and/or the processability of the product. These additives include known toughening agents, plasticizing agents, reinforcing agents, anti-mildew (antiseptic) agents, flame-retardant agents, and the like. The decorative layer of the one or more upper substrates is preferably formed by an ink layer digitally printed onto a supporting layer, such as the base layer or a primer layer applied onto the base layer. It is also conceivable that the decorative layer of the one or more upper substrates is formed by a printed synthetic film, such as a printed PET film or a printed PVC film.

In a preferred embodiment, at least one tile comprises a plurality of strip-shaped upper substrates affixed, either directly or indirectly, to an upper side of the base layer, wherein said upper substrates are arranged side by side in the same plane, preferably at least two upper substrates in a parallel configuration, and wherein facing longitudinal edges of at least two strip-shaped upper substrates are provided, near the top side, with a bevel. Preferably, each upper substrate, preferably each strip-shaped upper substrate, comprises a decorative layer and an abrasion-resistant wear layer covering said decorative layer, wherein a top surface of said wear layer is the top surface of said tile, and wherein the wear layer is a transparent and/or translucent material, such that the decorative layer is visible through the transparent wear layer. Preferably, facing longitudinal edges of at least two strip-shaped upper substrates are (each) provided, near the top side, with a bevel. The bevel is applied to prevent visible seam formation and secures a seamless engagement of adjacent upper substrates. Said bevel is preferably formed by a cut-away portion and/or imprinted portion and/or chamfered portion of a wear layer covering the decorative layer. Preferably, the bevel is positioned above the decorative layer. Preferably, the bevel leaves the decorative layer intact. Preferably, a transparent finishing layer is situated between the decorative layer and the wear layer. This finishing layer may be made of thermoplastic material, such as PVC or PET. Preferably, each strip-shaped upper substrate comprises a back layer situated between the base layer and the decorative layer. The back layer is preferably made of thermoplastic material, such as PVC or PET. Preferably, the back layer thickness is at least 50% of the thickness of the upper substrate. The back layer is preferably glued, fused, or welded to the base layer or to an intermediate layer, such as a primer layer, affixed to the top surface of the base layer. Preferably, the width of a top portion of the back layer is larger than the width of a bottom portion of the back layer, typically as seen in cross-section. Preferably, by cutting away (trimming) and/or deforming said bottom portion of the longitudinal edge, an improved seamless and tight engagement of adjacent upper substrates, at least near the top surface(s), can be obtained. Preferably, the bottom portion of opposite longitudinal edges of the back layer is chamfered. Said chamfer is preferably more inclined towards a (vertical) plane perpendicular to the plane defined by the tile than towards a (horizontal) plane parallel to the plane defined by the tile. The chamfer is preferably inclined inwardly in a downward direction (towards the base layer). During production, the upper substrates will be affixed, directly or indirectly, to the upper surface of the base layer, wherein the upper substrates are preferably positioned rather tightly next to each other. In case said narrowing width of the bottom portion of the upper substrate(s) is applied, it is imaginable that small air channels are formed between adjacent upper substrates, at or near the bottom side of said upper substrates. It is imaginable, and it may also be preferable, that short edges of the upper substrates together form a pair of opposite edges of the tile, preferably a pair of long edges of the tile. Here, it is preferred that the short edges of the upper substrate(s) are also provided, near the top surface, with a bevel, which allows or facilitates adjacent tiles to engage seamlessly with each other.

The upper substrate typically comprises a decorative layer and an abrasion-resistant wear layer covering said decorative layer, wherein a top surface of said wear layer is the top surface of said tile, and wherein the wear layer is a transparent material, such that the decorative layer is visible through the transparent wear layer.

The thickness of the upper substrate typically varies from about 0.1 to 3.5 mm, preferably from about 0.5 to 3.2 mm, more preferably from about 1 to 3 mm, and most preferably from about 2 to 2.5 mm. The thickness ratio of the foam base layer to the upper substrate commonly varies from about 1 to 15:0.1 to 3.5, preferably from about 1.5 to 10:0.5 to 3.2, more preferably from about 1.5 to 8:1 to 3, and most preferably from about 2 to 8:2 to 2.5, respectively.

Each tile may comprise an adhesive layer to affix the upper substrate, directly or indirectly, onto the base layer. The adhesive layer can be any well-known bonding agent or binder capable of bonding together the upper substrate and the foam base layer, for example, polyurethanes, epoxy resins, polyacrylates, ethylene-vinyl acetate copolymers, ethylene-acrylic acid copolymers, and the like. Preferably, the adhesive layer is a hot-melt bonding agent.

The decorative layer or design layer, which may be part of the upper substrate as mentioned above, can comprise any suitable known plastic material such as a known formulation of PVC resin, stabilizer, plasticizer, and other additives that are well known in the art. The design layer can be formed with or printed with printed patterns, such as wood grains, metal or stone designs, and fibrous patterns or three-dimensional figures. Thus, the design layer can provide the tile with a three-dimensional appearance that resembles heavier products such as granite, stone, or metal. The thickness of the design layer typically varies from about 0.01 to 0.1 mm, preferably from about 0.015 to 0.08 mm, more preferably from about 0.02 to 0.07 mm, and most preferably from about 0.02 to 0.05 mm.

The wear layer that typically forms the upper surface of the tile can comprise any suitable known abrasion-resistant material, such as an abrasion-resistant macromolecular material coated onto the layer beneath it, or a known ceramic bead coating. If the wear layer is furnished in layer form, it can be bonded to the layer beneath it. The wear layer can also comprise an organic polymer layer and/or inorganic material layer, such as an ultraviolet coating or a combination of another organic polymer layer and an ultraviolet coating. For example, an ultraviolet paint capable of improving the surface scratch resistance, glossiness, antimicrobial resistance, and other properties of the product. Other organic polymers including polyvinyl chloride resins or other polymers such as vinyl resins, and a suitable amount of plasticizing agent and other processing additives can be included, as needed.

In a preferred embodiment, at least one tile comprises a plurality of strip-shaped upper substrates directly or indirectly affixed to an upper side of the base layer, wherein said upper substrates are arranged side by side in the same plane. Here, preferably at least two upper substrates are oriented in a parallel configuration. Alternatively or additionally, at least two upper substrates are oriented in a perpendicular orientation. Preferably, at least one upper substrate is affixed to the upper side of the base layer, such that a longitudinal axis of said upper substrate is parallel with respect to one pair of opposite edges of the tile. Here, the plurality of upper substrates preferably substantially completely cover the upper surface of the base layer, and more preferably extend from the first edge to the second edge of the tile. Each of the plurality of upper substrates preferably comprises a decorative layer, wherein the decorative layers of at least two adjacently arranged upper substrates preferably have different appearances.

Preferably, the base layer comprises at least one foaming agent. The at least one foaming agent takes care of foaming of the base layer, which will reduce the density of the base layer. This will lead to lightweight tiles, which are lighter in weight in comparison with tiles that are dimensionally similar and have a non-foamed base layer. The preferred foaming agent depends on the (thermo)plastic material used in the base layer, as well as on the desired foam ratio, foam structure, and preferably also the desired (or required) foam temperature to realize the desired foam ratio and/or foam structure. To this end, it may be advantageous to apply a plurality of foaming agents configured to foam the base layer at different temperatures, respectively. This will allow the foamed base layer to be realized in a more gradual and controlled manner. Examples of two different foaming agents which may be present (simultaneously) in the base layer are azodicarbonamide (ADCA) and sodium bicarbonate. These foaming agents are preferred to be used together due to their synergy. Both components exhibit very different decomposition behaviors. ADCA decomposes exothermically and will lose the major mass over a narrow, but relatively high, temperature range of 190-210 degrees Celsius. This decomposition temperature can be, and is preferably, reduced by activating ADCA by using ADCA with an activator, also referred to as a kicker. Suitable activators for ADCA are, e.g., dibasic lead phosphite, zinc oxide, zinc stearate, calcium carbonate, magnesium oxide, silica, and other mineral compounds. Sodium bicarbonate was found to decompose over a broader, but relatively low, temperature range of 100-140 degrees Celsius. The actual decomposition temperature can be, and is preferably, lowered by using, e.g., citric acid, preferably anhydrous citric acid, as an activator. The use of ADCA results in a rapid decrease of foam density. The synergism between the two foaming agents results in the fact that the combination of ADCA and sodium bicarbonate leads to a relatively low foam density with a fine, even cell structure. The generation of this fine cell structure has led to the conclusion that gas bubbles, in particular nitrogen gas, produced from the decomposition of ADCA act as sites for the nucleation of carbon dioxide bubbles resulting from the decomposition.

In this respect, it is often also advantageous to apply at least one modifying agent, such as methyl methacrylate (MMA) and/or butyl acrylate-methyl methacrylate (BAMMA), in order to keep the foam structure relatively consistent throughout the base layer. Preferably, the weight content of the modifying agent, preferably MMA or BAMMA, is situated between 2% and 5%, more preferably between 3% and 4%.

Preferably, chlorinated PVC (CPVC) and/or chlorinated polyethylene (CPE) and/or another chlorinated thermoplastic material is used further to improve the hardness and stiffness of the base layers and of the tiles as such, thereby reducing the fragility of the vertices of each tile.

Polyvinyl chloride (PVC) foam materials are especially suitable for forming the foam base layer because they are chemically stable, corrosion-resistant, and have excellent flame-retardant properties. The plastic material used as foam plastic material in the base layer is preferably free of any plasticizer in order to increase the desired rigidity of the base layer, which is, moreover, also favorable from an environmental point of view. Preferably, the composite of the base layer comprises between 35% and 50%, and more preferably between 40% and 45%, thermoplastic material, in particular PVC.

The base layer may also at least partially be composed of a (PVC-free) thermoplastic composition. This thermoplastic composition may comprise a polymer matrix comprising (a) at least one ionomer and/or at least one acid copolymer; and (b) at least one styrenic thermoplastic polymer, and, optionally, at least one filler. An ionomer is understood as being a copolymer that comprises repeat units of electrically neutral and ionized units. Ionized units of ionomers may be, in particular, carboxylic acid groups that are partially neutralized with metal cations. Ionic groups, usually present in low amounts (typically less than 15 mol % of constitutional units), cause micro-phase separation of ionic domains from the continuous polymer phase and act as physical crosslinks. The result is an ionically strengthened thermoplastic with enhanced physical properties compared to conventional plastics.

The composite of the base layer preferably comprises one or more fillers, wherein at least one filler is selected from the group comprising talc, chalk, wood, calcium carbonate, titanium dioxide, calcined clay, porcelain, another mineral filler, and another natural filler. The filler, preferably chosen from the above group, may be formed by fibers and/or may be formed by dust-like particles. Here, the expression "dust" is understood as small dust-like particles (powder), like wood dust, cork dust, or non-wood dust like mineral dust or stone powder, in particular cement. The average particle size of the dust is preferably between 14 and 20 microns, more preferably between 16 and 18 microns.

The primary role of this type of filler, as mentioned in this paragraph, is to give the base layer and the tiles sufficient hardness. Moreover, this kind of filler will typically also improve the impact strength of the base layer and of the tiles as such. The weight content of this kind of filler in the composite is preferably between 35% and 75%, more preferably between 40% and 48%, most preferably between 45% and 48% in case the composite is a foamed composite, and more preferably between 65% and 70% in case the composite is a non-foamed (solid) composite.

In a particularly preferred embodiment, the composite of the base layer comprises 40-45% by weight PVC and 45-48% by weight mineral filler, in particular calcium carbonate (chalk). Research has shown that this combination of materials and material ranges provides excellent properties to the base layers in terms of hardness (robustness/rigidity) and flexibility to further reduce the risk of breakage of the panel during use, in particular during coupling. A higher content of calcium carbonate (>48%) will typically lead to a fragile composition which may break rather easily, while a lower content of calcium carbonate (<45%) typically leads to a composite which is too flexible and not sufficiently hard (rigid) to allow the panels to function properly. A lower content of PVC (<40%) will typically lead to a too rigid composite to allow the panels to function properly, and, moreover, as PVC acts as a binding agent (binding matrix), such a relatively low content typically affects proper and stable binding of the composite as such. Preferably, the weight content of the modifying agent, preferably MMA, present in the composite, is situated between 2% and 5%, more preferably between 3% and 4%.

In an alternative configuration of the tile system according to the invention, each tile comprises a substantially rigid base layer at least partially made of a non-foamed (solid) composite comprising at least one plastic material and at least one filler. A solid base layer may lead to improved tile strength, and hence a reduced vulnerability of the pointed vertexes, and may further improve the suitability to use the tiles to realize a chevron pattern. A drawback of applying a solid composite in the base layer instead of a foamed composite in the base layer is that the tile weight will increase (in case base layers of identical thicknesses would be applied), which may lead to higher handling costs and higher material costs.

Preferably, the composite of the base layer comprises at least one filler selected from the group comprising a salt, a stearate salt, calcium stearate, and zinc stearate. Stearates have the function of a stabilizer and may act as a foaming agent activator, leading to a more beneficial processing temperature and counteracting decomposition of components of the composite during processing and after processing, which therefore provide long-term stability. Instead of or in addition to a stearate, for example, calcium zinc or zinc oxide may also be used as a stabilizer. The weight content of the stabilizer(s), in particular zinc stearate, in the composite will preferably be between 1% and 5%, and more preferably between 1.5% and 4%, most preferably between 1% and 2%.

The composite of the base layer preferably comprises at least one impact modifier comprising at least one alkyl methacrylate, wherein said alkyl methacrylate is preferably chosen from the group comprising methyl methacrylate, ethyl methacrylate, propyl methacrylate, isopropyl methacrylate, t-butyl methacrylate, and isobutyl methacrylate. The impact modifier typically improves the product performance, in particular the impact resistance. Moreover, the impact modifier typically toughens the base layer and can therefore also be seen as a toughening agent, which further reduces the risk of breakage. Often, the modifier also facilitates the production process, for example, as already addressed above, in order to control the formation of the foam with a relatively consistent (constant) foam structure. The weight content of the impact modifier in the composite will preferably be between 1% and 9%, and more preferably between 3% and 6%. Preferably, the substantially complete base layer is formed by the foamed composite.

At least one plastic material used in the base layer is preferably free of any plasticizer in order to increase the desired rigidity of the base layer, which is, moreover, also favorable from an environmental point of view.

The density of the foam base layer typically varies from about 0.1 to 1.5 grams/cm$^3$, preferably from about 0.2 to 1.4 grams/cm$^3$, more preferably from about 0.3 to 1.3 grams/cm$^3$, even more preferably from about 0.4 to 1.2 grams/cm$^3$, even more preferably from about 0.5 to 1.2 grams/cm$^3$, and most preferably from about 0.6 to 1.2 grams/cm$^3$. Preferably, the foam has a relatively uniform (closed or open) cell distribution, at least in its center portion and possibly also at the upper portion and bottom portion. The upper portion and bottom portion of the foam base layer may have a larger density than the center portion of the foam base layer.

The plastic foam used in the base layer preferably has an elastic modulus of more than 700 MPa (at a temperature of 23 degrees Celsius and a relative humidity of 50%). This will generally have sufficient stiffness in relation to the base layer and, therefore, in relation to the tile.

The density of the base layer preferably varies along the height of the base layer. This may positively influence the acoustic (sound-dampening) properties of the tiles as such. Preferably, at a top section (top portion) and/or a bottom section (bottom portion) of the foamed base layer, a crust layer may be formed. This at least one crust layer may form an integral part of the base layer. More preferably, both the top section and the bottom section of the base layer form a crust layer enclosing the foam structure. The crust layer is relatively closed (reduced porosity, or even free of bubbles (cells)), and hence forms a relatively rigid (sub)layer compared to the more porous foam structure. Commonly, though not necessarily, the crust layer is formed by sealing (searing) the bottom and top surface of the core layer. Preferably, the thickness of each crust layer is between 0.01 and 1 mm, preferably between 0.1 and 0.8 mm, more preferably between 0.4 and 0.6 mm. A too thick crust will lead to a higher average density of the core layer, which increases both the costs and the rigidity of the core layer. A center section (center portion) of the foamed base layer is enclosed by both crust layers. Preferably, the thickness of the center section is at least 40%, more preferably at least 50% of the thickness of a crust layer. In general, it is indicated that the average cell size of the foamed base layer, or at least a part thereof (e.g., within the center portion of the base layer), is preferably situated between 60 and 140 microns, more preferably between 80 and 120 microns. Preferably, the cell size of the foamed base layer, or at least a part thereof (e.g., within the center portion of the base layer), has a relatively narrow cell distribution ranging from 60 to 140 microns, more preferably from 80 to 120 microns. This narrow cell distribution can, for example, be obtained by using a combination of foaming agents, wherein the decomposition temperatures of the foaming agents are mutually different.

The thickness of the base layer (core layer) as such is preferably between 2 and 10 mm, more preferably between 3 and 8 mm, and is typically approximately 4 or 5 mm. Preferably, a top section and/or a bottom section of the (composite) base layer forms a crust layer having a porosity which is less than the porosity of the closed-cell foam plastic material of the base layer, wherein the thickness of each crust layer is preferably between 0.01 and 1 mm, preferably between 0.1 and 0.8 mm.

Preferably, each tile comprises at least one backing layer affixed to a bottom side of the base layer, wherein said at least one backing layer is at least partially made of a flexible material, preferably an elastomer. The thickness of the backing layer typically varies from about 0.1 to 2.5 mm. Non-limiting examples of materials from which the backing layer can be made include polyethylene, cork, polyurethane, and ethylene-vinyl acetate. The thickness of a polyethylene backing layer is, for example, typically 2 mm or smaller. The backing layer commonly provides additional robustness and impact resistance to each tile, which increases the durability of the tiles. Moreover, the (flexible) backing layer may increase the acoustic (sound-dampening) properties of the tiles. In a particular embodiment, the base layer is composed of a plurality of separate base layer segments affixed to said at least one backing layer, preferably such that said base layer segments are mutually hingeable. The lightweight features of the tiles are advantageous for obtaining a secure bond when installing the tile on vertical wall surfaces. It is also especially easy to install the tile at vertical corners, such as at inside corners of intersecting walls, pieces of furniture, and at outside corners, such as at entryways. An inside or outside corner installation is accomplished by forming a groove in the foam base layer of the tile to facilitate bending or folding of the tile.

At least one reinforcing layer may be situated between the base layer and the upper substrate. This may lead to further improvement of the rigidity of the tiles. This may also lead to improvement of the acoustic (sound-dampening) properties of the tiles. The reinforcement layer may comprise a woven or non-woven fiber material, for example, a glass fiber material. They may have a thickness of 0.2-0.4 mm. It is also conceivable that each tile comprises a plurality of (commonly thinner) base layers stacked on top of each other, wherein, optionally, at least one reinforcing layer is situated between two adjacent base layers. Preferably, the density of the reinforcing layer is preferably situated between 1,000 and 2,000 kg/m$^3$, preferably between 1.400 and 1.900 kg/m$^3$, and more preferably between 1.400 and 1,700 kg/m$^3$.

It is also imaginable that the base layer comprises a laminate of composite layers stacked on top of each other. Such a multi-layer base layer may, for example, be formed by co-extrusion. The different composite layers of the base layer may have a different composition. However, it is also imaginable that the composition of the different layers of the base layer is identical, though the structure of different layers is different. It is, for example, imaginable that at least one composite layer of the base layer has a solid structure, while at least one other composite layer of the base layer has a foam structure. It is in particular imaginable, and this may also be preferable, that the multilayer base layer comprises at least two solid composite layers enclosing at least one foam composite layer.

Preferably, the complete first mechanical coupling means and/or the complete second mechanical coupling means and/or the complete third mechanical layer is/are integrally connected to the base layer. This may also be understood as that the first mechanical coupling means and/or the complete second mechanical coupling means and/or the complete third mechanical layer is/are integrally formed within and/or formed by the base layer.

As discussed above, the first coupling profile and/or the second and/or third coupling profiles are predominantly rigid, but the second and/or third coupling profiles allow (slight) deformation during coupling and uncoupling, greatly facilitating this process.

According to a general embodiment of the invention, it can also be considered as follows: the first pair of opposite sides is provided with pairs of opposite first mechanical coupling devices to make the said tiles at least vertically and preferably also horizontally attached, comprising: a first coupling profile comprising a lateral tongue extending in a direction parallel to the top of the tile; and an opposite second coupling profile comprising a recess configured to accommodate at least part of the lateral tongue of another tile, where that recess is defined by an upper lip and a lower lip, where the said first mechanical coupling profiles allow these tiles to be locked together by tilting inwards, carrying at least part of the lateral tongue through the recess; and where the second pair of opposite sides is fitted with pairs of opposite second mechanical coupling devices for the purpose of locking the said tiles together vertically and horizontally, comprising: a coupling profile identical to the previous one, comprising: a first coupling profile comprising a lateral tongue extending in a direction parallel to the top of the tile; and an opposite second coupling profile comprising a recess configured to accommodate at least part of the lateral tongue of another tile, where this recess is defined by an upper lip and a lower lip, where said first mechanical coupling profiles allow said tiles to be locked together by pushing the lateral tongue into the recess.

The alignment edges are preferably formed by a flat surface so that the conduction of another coupling part while connecting two tiles can generally be as controlled as possible.

However, applying a rounded alignment edge is also conceivable. In another variant, at least part of the alignment edge of the second coupling section has a markedly flatter orientation than at least part of the upward flank of the first and/or third coupling section. Due to this measure, in a coupled position, there is generally an air gap between the alignment edge of the second and/or third coupling section and a flank of the first coupling section. This deliberately created play between the two coupling parts is usually advantageous during the coupling of adjacent tiles, as this play does not prevent a temporary deformation of the coupling parts, thus facilitating their connection. In addition, the clearance created is advantageous for absorbing expansion of the tile, for example, due to changes in the ambient temperature.

The invention also relates to tiles, particularly floor coverings, wall coverings, ceiling coverings, and furniture coverings, which consist of interconnected tiles according to the invention. According to the invention, the invention also relates to a tile for use in a multi-purpose tile system.

BRIEF DESCRIPTION OF THE DRAWINGS

The invention will be illustrated using non-exhaustive examples shown in the following figures. It shows.

PARTS

Figure 1:
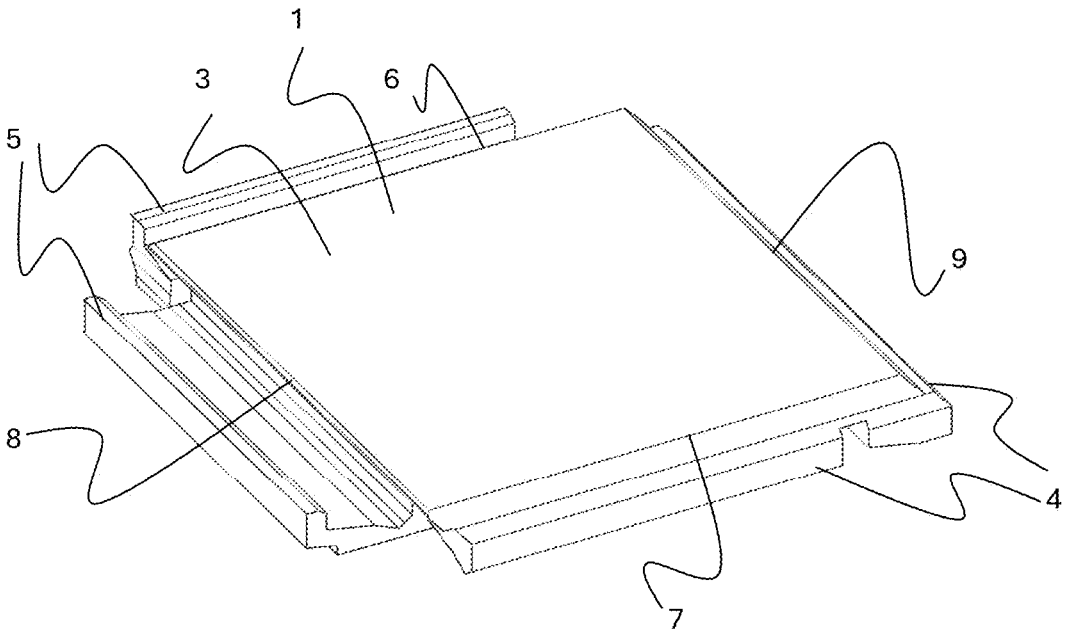
FIG. 1: Schematic perspective representation of the top of a tile where two sides are provided with a first coupling profile and two sides are provided with a second coupling profile according to a design as shown in FIG. 6 according to the invention.

Tile 1
Bottom of the tile 2
Top surface of the tile 3
First coupling profile 4
Second coupling profile 5
First edge 6
Second edge 7
Third edge 8
Fourth edge 9
Recess (second locking means) 10
First locking means 11
Second locking means 12
Lateral tongue 13
Upper lip 14
Blocking recess (first locking means) 15
Lower lip 16
Upward flank 17
Spring point 18
Blocking lip 19
Downward side flank (short) 20
Downward side flank (long) 21
Top of the lateral tongue 22
Top of the blocking recess 23
Top surface of the lower lip 24
Bottom Surface of the upper lip 25
Bottom side of lateral tongue 26
Bevel of the lateral tongue 27
Chamfer of the upper lip 28
Bottom part of the lower lip 29
Head side of the first coupling 30
Head side of the second coupling 31
Niche 32
Core (of the tile) 33
Top of the blocking lip 34
Chamfer of the blocking lip 35
Inside flank of the blocking lip of the second coupling profile 36
Chamfer of the upward flank 37
Chamfer of the lateral tongue 38
Protrusion 39
Additional recess 40
Additional point 41
Bevel of the upper lip 42
Third Coupling profile 43
Third locking means 44
Further lower lip of the first coupling profile 45
Further recess (first locking means) 46
Spring Point (first locking means) 47
Blocking lip (first locking means 48
First blocking recess (third locking means) 49
Head side of the third coupling profile 50
Tooth (third locking means) 51
Second blocking recess (third locking means) 52
Recess in the head flank of the third coupling means 53
Upper surface of the tooth 54
Top surface of the tooth 55
Lower surface of the tooth 56
Second flank of the second blocking recess 57
First flank of the first blocking recess of the third locking means 58
Second flank of the first blocking recess of the third locking means 59
Upper side of the first blocking recess of the third locking means 60
Top of the blocking lip 61
Intermediate profile 62
Bevel of the third locking means 63
First flank of the second blocking recess 64
Inside flank of the blocking lip of the first locking means 65
Head flank of the lower lip of the second coupling profile 66
Lower surface of the intermediate profile 67
Further upper lip of the first coupling profile 68
Upward flank (first coupling profile) 69
Facial surface of the upper lip of the first coupling profile 70
Upper side of the second blocking recess of the third locking means 71

DESCRIPTION OF THE INVENTION

The following detailed description, supported by the figures, relates to coupling mechanisms specifically designed to connect different components in a mechanical assembly. The description will outline two primary types of couplings. The first type of coupling is depicted in FIGS. 1-11, illustrating a basic variant of the coupling mechanism. Additionally, a second type of coupling, providing supplemental functionality, is shown in FIGS. 12-17. These two variants demonstrate the flexibility and adaptability of the system.

The basis of the techniques is the same for both versions, where the insertion of one coupling profile can be done via both a tilting movement and a dropdown movement.

It should be noted that the protection sought for this invention is not limited to the embodiments described and illustrated in the figures. Variations and modifications of the couplings may be implemented without departing from the scope of the invention, as defined in the accompanying claims. The embodiments described herein serve as examples to demonstrate the invention's principles and applications, as well as other configurations and adaptations envisioned within the framework of this patent.

According to a first embodiment, the coupling between the tiles to be connected comprises a combination of the first and second coupling profiles.

Figure 6:
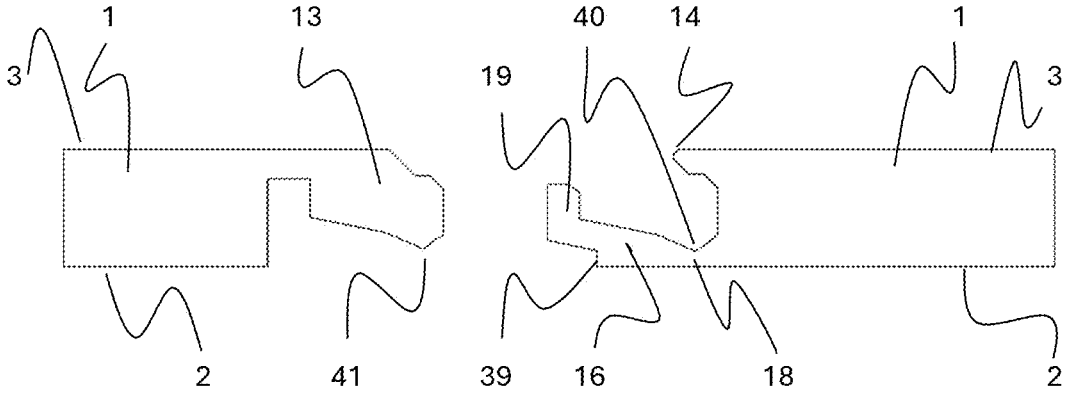
FIG. 6: Schematic side-view representation of a tile with a first coupling profile on a first tile and a second coupling profile on another tile of an additional embodiment according to the invention.

FIG. 1 shows a schematic perspective representation of the top of tile 1 where two sides are provided with a first coupling profile 4 and two sides are provided with a second coupling profile 5, according to a design as shown in FIG. 6 according to the invention.

The illustration shows tile 1 equipped with two first coupling profiles 4, respectively positioned on second edge 7 and fourth edge 9 and thus adjacent, and two second coupling profiles 5, placed on the first edge 6 and third edge 8 respectively and thus also adjacent.

The shape of tile 1 is shown here as rectangular, but it can also be square, parallelogram, or even trapezoidal. The first coupling profile 4 and second coupling profile 5 are explained in more detail in FIGS. 3, 4, and 5.

The top of tile 1 is preferably composed of a suitable top layer, as described in the summary.

Figure 2:
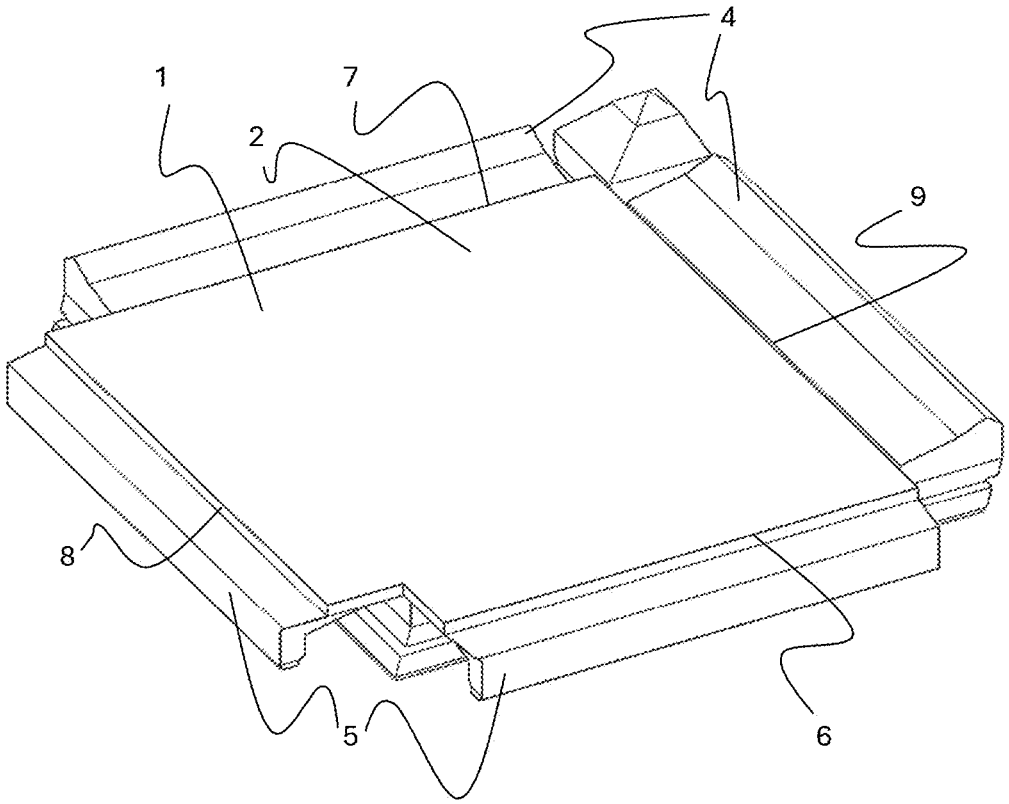
FIG. 2: Perspective view of the bottom of a tile where two sides are provided with a first coupling profile and two sides are provided with a second coupling profile according to a design as shown in FIG. 6 according to the invention.

FIG. 2 shows a schematic perspective representation of the bottom of tile 1 where two sides are provided with a first coupling profile 4 and two sides are provided with a second coupling profile 5 according to a design as shown in FIG. 6 according to the invention. The configuration is identical to that described in FIG. 1.

Figure 3A:
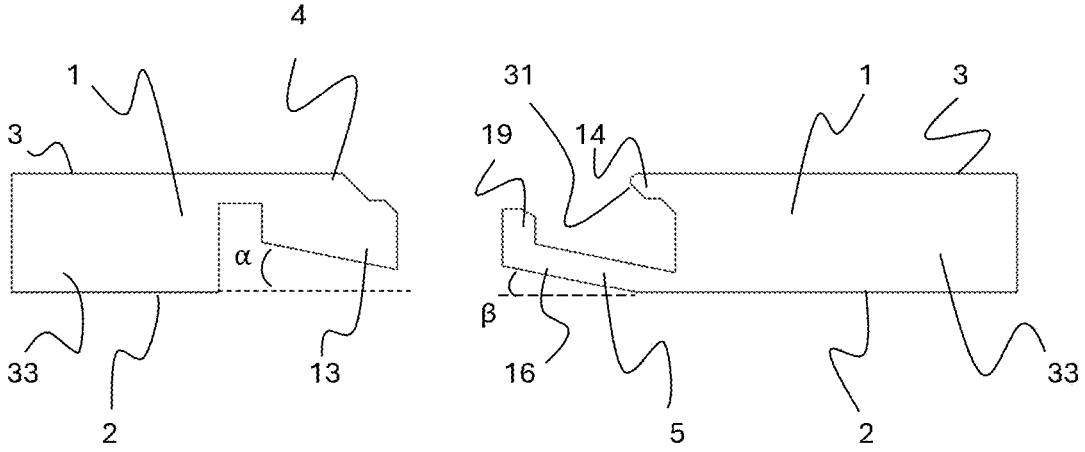
FIG. 3*a*: Schematic side-view representation of a tile with a first coupling profile on a first tile and a second coupling profile on another tile in an unconnected position according to the invention.
Figure 4:
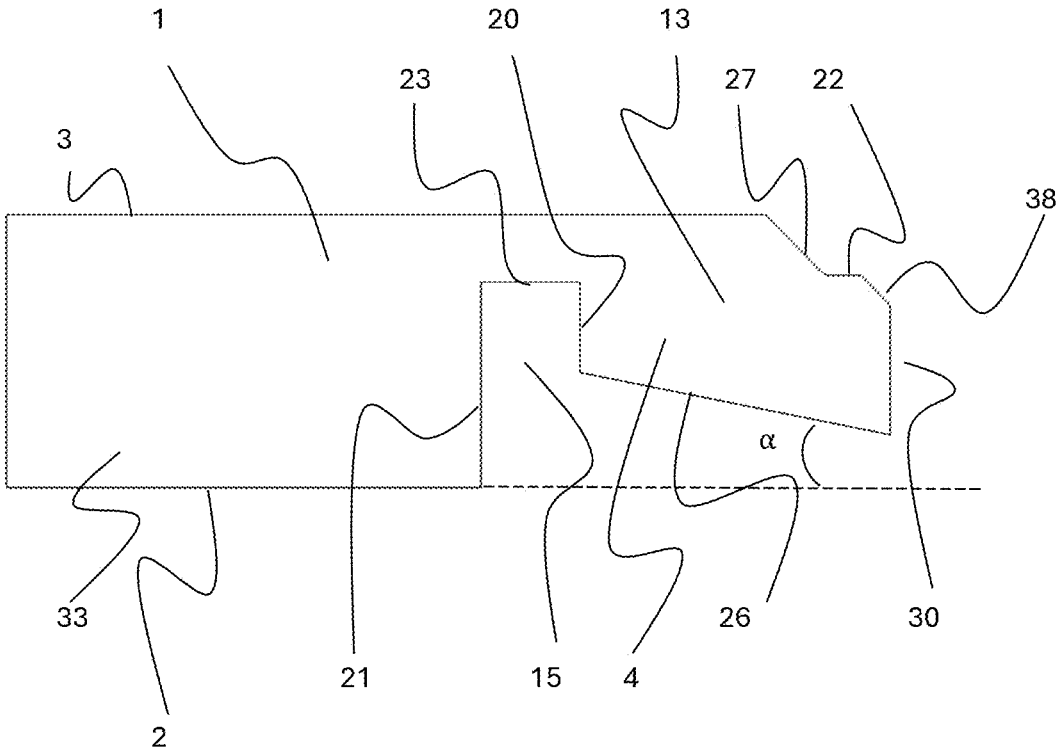
FIG. 4: Schematic side-view representation of a tile with a first coupling profile in detail on a first tile according to the invention.
Figure 5:
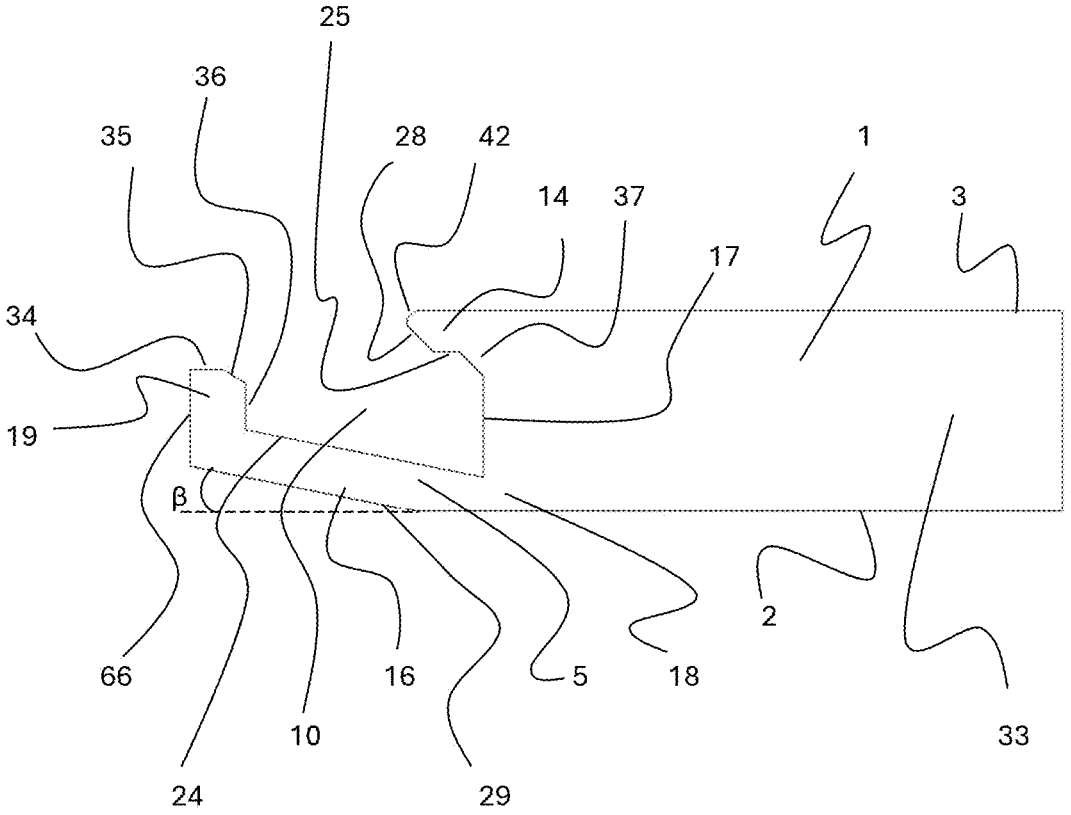
FIG. 5: Schematic side-view representation of a tile with a second coupling profile in detail on a second tile according to the invention.

FIG. 3*a* shows a schematic side-view representation of a tile 1 with a first coupling profile 4 on a first tile 1 and a second coupling profile 5 on another tile 1 in a decoupled position. FIGS. 4 and 5 give a more detailed explanation of the two couplings, as shown in FIGS. 3*a* and 3*b*.

Figure 3B:
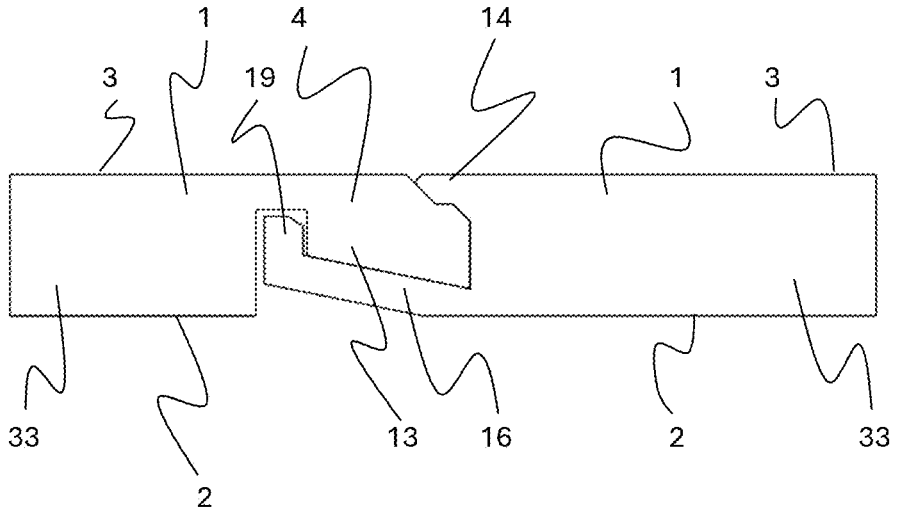
FIG. 3*b*: Side-view schematic representation of a tile with a first coupling profile on a first tile and a second coupling profile on another tile in a coupled position according to the invention.

FIG. 3*b* shows a schematic side-view representation of tile 1 with a first coupling profile 4 on a first tile 1 and a second coupling profile 5 on another tile 1 in a coupled position. FIGS. 4 and 5 give a more detailed explanation of the two couplings as shown in FIGS. 3*a* and 3*b*.

FIG. 4 shows a schematic side-view representation where the first coupling profile 4 is provided on tile 1, and the top surface of tile 3 of tile 1 and the bottom of tile 2 of tile 1 are parallel. Between these is a, preferably waterproof, core 33. The first coupling profile 4 comprises a lateral tongue 13 formed mainly by the top of the lateral tongue 22, a head side 30 of the first coupling profile 4, a bottom side 26 of the lateral tongue 13, and the blocking recess 15. The angle α between the horizontal plane and the plane of the bottom side 26 of the lateral tongue 13 is preferably between 10° and 45°, but preferably not less than 10° and at least 5°.

In the preferred versions shown in FIGS. 1-11, the transition between the top surface 3 of tile 1 and the top 22 of the lateral tongue 13 is provided with a bevel 27 of the lateral tongue 13 at an angle of 45°. The transition between the top 22 of the lateral tongue 13 and the head side 30 of the first coupling profile 4 is provided with a chamfer 38 on the lateral tongue 13 at an angle of 45°. The blocking recess 15 is formed by the short downward flank 20, and the top of the blocking recess 23 of the blocking recess 15, preferably rectangular in shape. The bottom side 26 of the lateral tongue 13 is at an angle of 11° in this version though it may vary depending on the thickness of the tile 1, the material composition, and the desired interaction between the couplings.

FIG. 5 shows a schematic side-view representation where the second coupling profile 5 is provided on tile 1 and where the top surface of tile 3 of tile 1 and the bottom 2 of tile 1 are parallel. Between these is a preferably waterproof core 33. The second coupling profile 5 comprises two main parts, the first is an upper lip 14, primarily formed by the bottom surface 25 of the upper lip 14, a bevel 42 of the upper lip 14, and the chamfer 28 of the upper lip 14. A second central part comprises a lower lip 16, formed by the top surface 24 of the lower lip 16, the upward flank 17, and the blocking lip 19.

The angle β between the horizontal plane extending the surface of the bottom 2 of the tile 1 and the bottom part 29 of lower lip 16 is preferably between 10° and 45°, but preferably not less than 10° and at least 5°.

In the preferred versions, as shown in FIGS. 1-11, the transition between the bottom surface 25 of the upper lip 14 and the upward flank 17 is provided with a chamfer 37 on the upward flank 17. The upward flank 17 connects the upper lip 14 and the lower lip 16. It is preferably positioned vertically and has the same shape as the head side 30 of the lateral tongue 13.

The top surface 24 of the lower lip 16 preferably has the same angle as the bottom side or 26 of the lateral tongue 13 and is preferably flat in shape.

In this version, the top surface 24 of the lower lip 16 is parallel to the bottom surface 29 of the lower lip 24 and thus has the same angle as the top surface of the lower lip 24 and, therefore, also the bottom side 26 of the lateral tongue 13. The blocking lip 19 is formed by the head side 66 of the second coupling profile 5, the top 34 of the blocking lip 19, the chamfer 35 of the blocking lip 19, and the inside flank 36 of the blocking lip 19. In this version, the inside flank 36 of the blocking lip 19 has an angle of 45°. The spring point 18 is positioned at the intersection of the upward flank 17 with the top surface 24 of the lower lip 16.

FIG. 6 shows a schematic side-view representation of a tile 1 with a first coupling profile 4 on a first tile 1 and a second coupling profile 5 on another tile 1 of an additional embodiment where the bottom side 26 of the lateral tongue 13 is provided with an extra point 41 and the top surface 24 of the lower lip 16 with an additional recess 40. This version has the advantage that when used as a drop lock coupling, the additional point 41 contributes to the lateral tongue 13 hooking more efficiently behind the blocking lip 19 of the lower lip 16.

Additionally, an additional protrusion 39 is provided on the lower part of the bottom part 29 of the lower lip 16, which reduces the air space under the lower lip 16 compared to the version shown in FIG. 3. This protrusion 39 functions as a click point to increase the back-pressure generated by the blocking lip 19.

Figure 7:
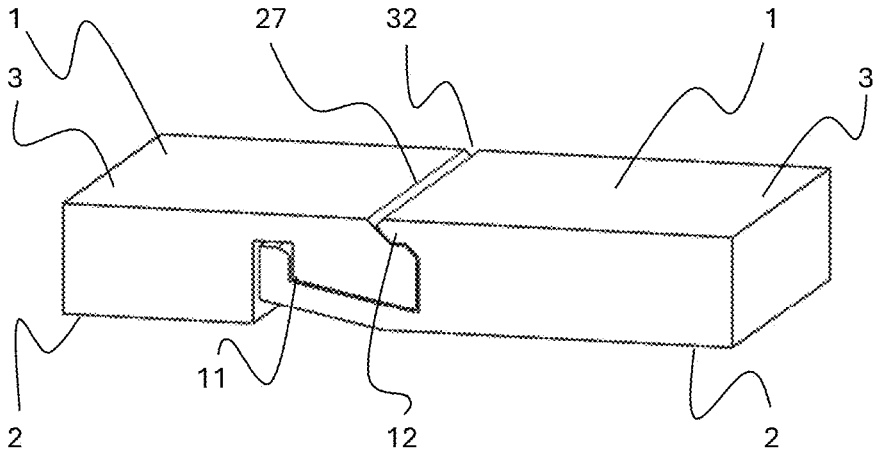
FIG. 7: Schematic perspective representation of a tile with a first coupling profile and a second coupling profile on another tile in a coupled position according to the invention.

FIG. 7 shows a schematic perspective representation of tile 1 with a first coupling profile 4 and a second coupling profile 5 on another tile 1 in a coupled position where the lateral tongue 13 of the first coupling profile 4 fits into the recess 10 of the second coupling profile 5. The edges seal the shape nicely to ensure the watertightness of the coupling.

The head side 30 of the first coupling profile 4 preferably touches almost the entire surface of the upward flank 17, and the chamfer of the blocking lip 35 is positioned at the level of the short downward flank 20. As a result, the coupling is locked horizontally, which can be considered as the first locking means 11. The bottom side 26 of the lateral tongue 13 touches the top surface 24 of the lower lip 16, while the top 22 of the lateral tongue 13 is positioned against the bottom surface 25 of the upper lip 14. Consequently, the coupling is locked in the vertical direction and acts as second locking means 12.

In this preferred version, the niche 32 is formed in the coupled state by combining bevel 27 of the lateral tongue 13 and bevel 42 on the upper lip 14.

Figure 8:
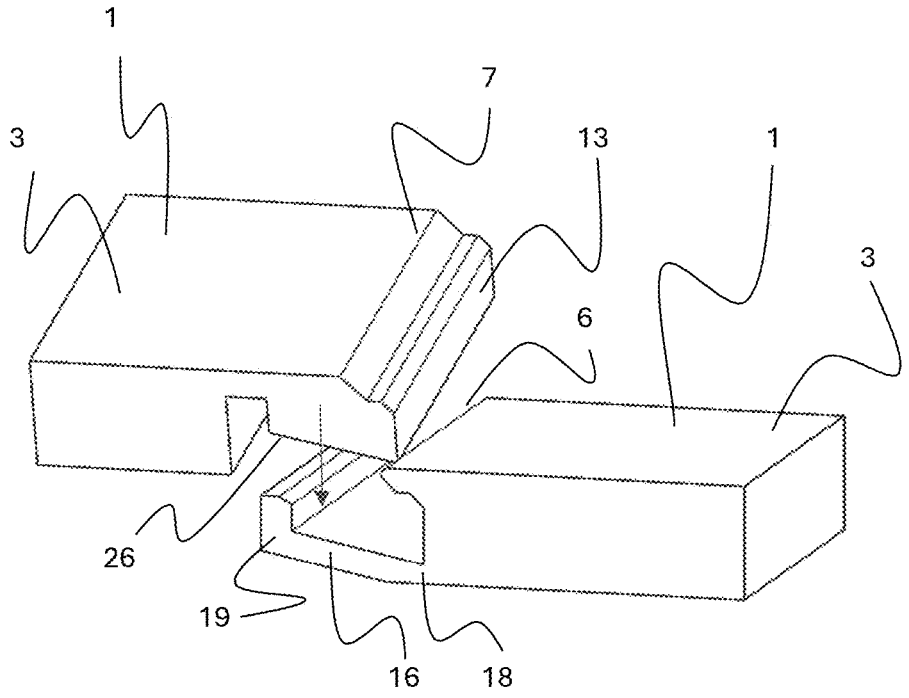
FIG. 8: Schematic perspective representation of a tile with a first coupling profile and a second coupling profile on another tile where the first coupling profile moves vertically in the direction of the second coupling profile according to the invention.
Figure 9:
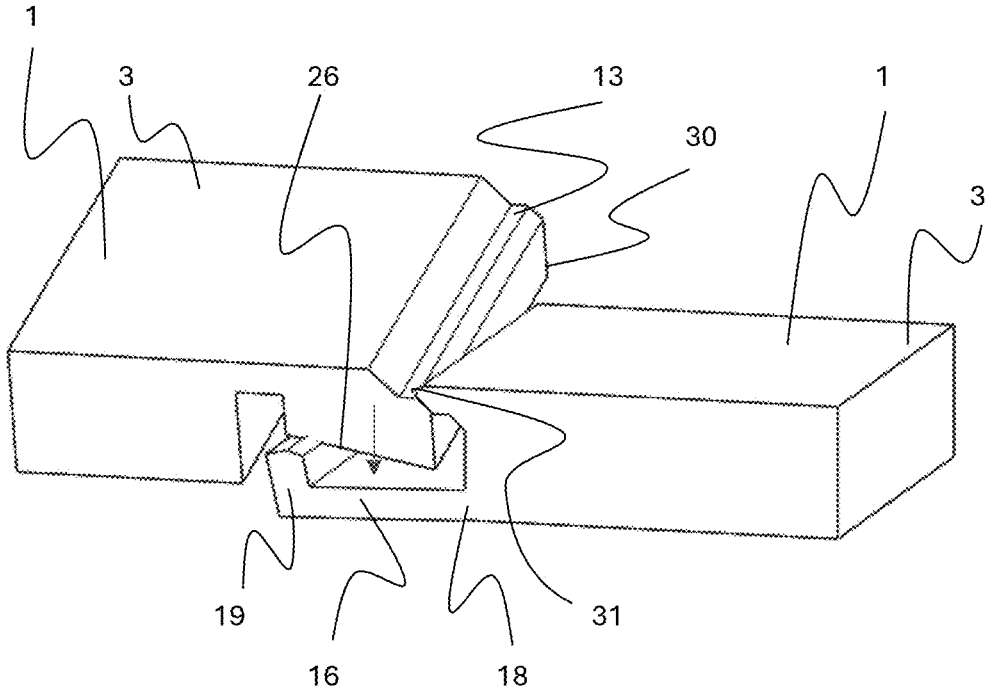
FIG. 9: Schematic perspective representation of a tile with a first coupling profile and a second coupling profile on another tile where the first coupling profile exerts a vertical pressure on the second coupling profile according to the invention.
Figure 10:
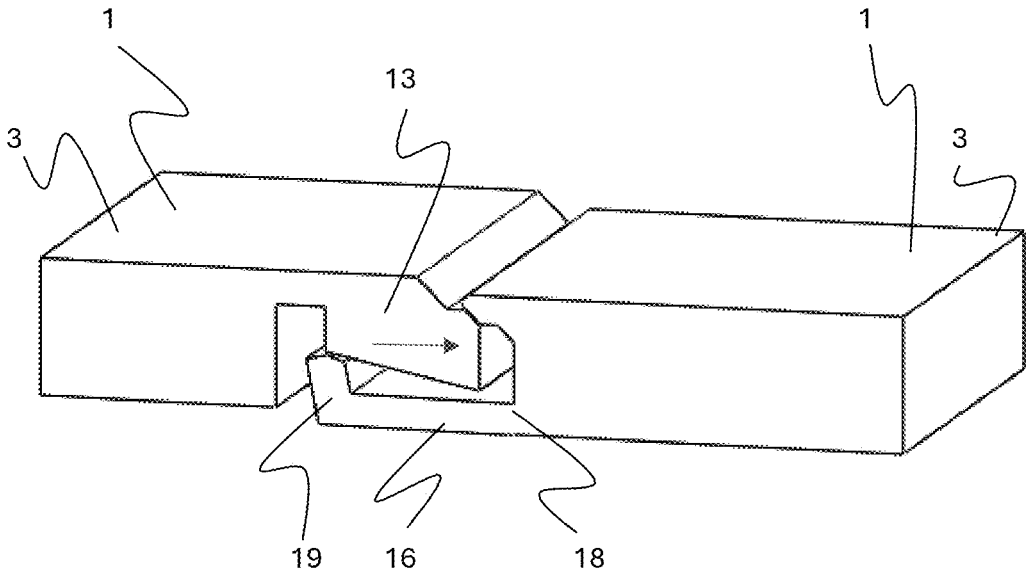
FIG. 10: Schematic perspective representation of the first coupling profile of a tile intervening horizontally in a second coupling profile on another tile according to the invention.
Figure 11:
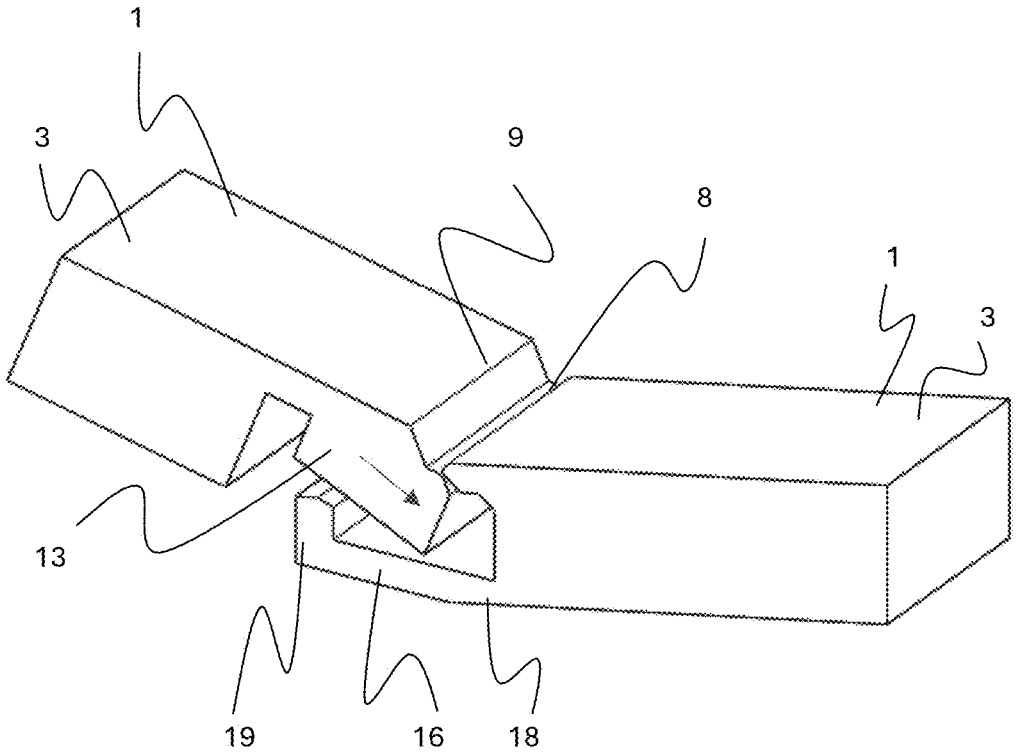
FIG. 11: Schematic perspective representation of the first coupling profile of a tile that intervenes in a second coupling profile on another tile according to the invention via a tilting movement.

FIGS. 8-10 illustrate the interaction between the first coupling profile 4 and the second coupling profile 5 as a drop lock coupling. FIG. 11 shows the interaction between the first coupling profile 4 and the second coupling profile 5 as click coupling.

FIG. 8: is a schematic perspective representation of a tile 1 with a first coupling profile 4 and a second coupling profile 5 on another tile 1 where the second coupling profile 5 moves vertically towards the first coupling profile 4. In a possible situation where the tile 1 is clicked via the lateral tongue 13 on the fourth edge 9 into the recess 10 of the second coupling profile 5 on the third edge 8 of an adjacent tile 1, the lateral tongue 13 on the second edge 7 makes a scissoring movement relative to the second coupling profile 5 on the first edge 6 of an adjacent tile 1. When the scissoring movement continues, the bottom side 26 of the lateral tongue 13 will exert pressure on the top 34 of the blocking lip 19, causing the blocking lip 19 to exert pressure on the lower lip 16. As a result, the lower lip 16 will be pushed down and essentially will fill the free space under the lower lip 16. The lower lip 16 will mainly move around the spring point 18 and create a springy effect, as illustrated in FIG. 9. In this movement, under pressure from the blocking lip 19 on the bottom side 26 of the lateral tongue 13, pressure is exerted from the inside flank of the head side 30 of the first coupling profile 4 of the lateral tongue 13 to the head side 31 of the upper lip 14 of the second coupling profile 5.

Once the lateral tongue 13 reaches a horizontal position, the lateral tongue 13 is pushed into the recess 10 of the second coupling profile 5 under the pressure from the blocking lip 19 on the bottom side 26 of the lateral tongue 13. The chamfer 38 on the lateral tongue 13 makes contact with the chamfer of the upper lip 28 of the upper lip 14 so the lateral tongue 13 can no longer be moved upwards and is secured into the recess 10, as shown in FIG. 10. Once the lateral tongue 13 fills the space of the recess 10, the blocking lip 19 returns to its original position, as illustrated in FIG. 7.

FIG. 11 shows a schematic perspective representation where the second coupling profile 5 of tile 1 engages with a second coupling profile 5 on another tile 1 via a tilting movement. In this case, the lower lip 16 barely deforms, and the operation can be considered similar to a traditional coupling where a lip is inserted at a certain angle into a recess 10 in the click joint.

According to a second embodiment, the coupling between the tile 1 to be connected comprises a combination of a first, second, and third coupling profile.

Figure 12:
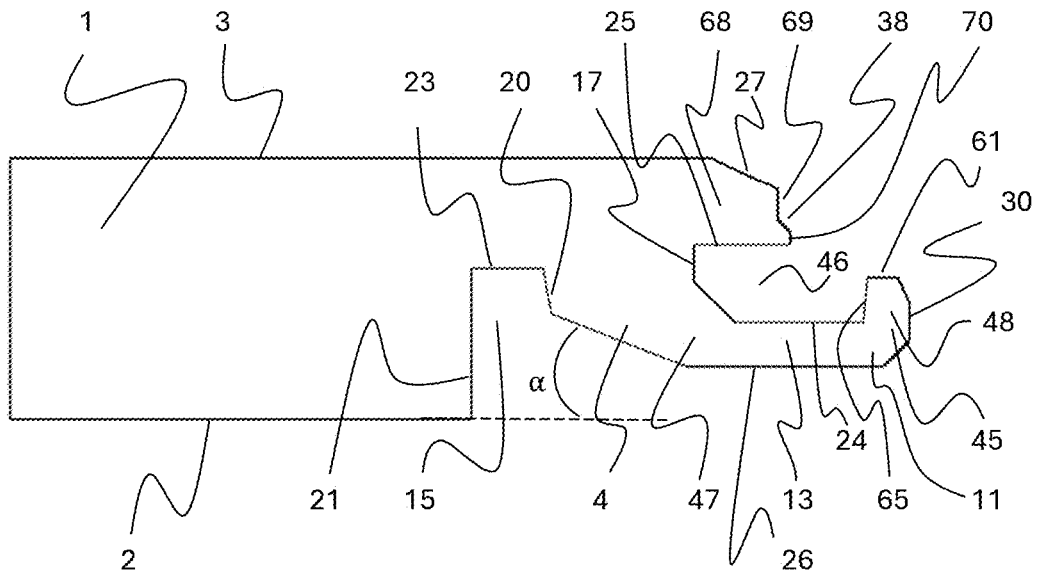
FIG. 12: Schematic side-view representation in detail of a tile with a first coupling profile according to an additional embodiment in which the first coupling profile can be connected to a second and third coupling profile.

A first coupling profile 4, according to the second embodiment, is shown in FIG. 12, where the general structure of the coupling profile is essentially the same as the coupling profile shown in FIG. 4. However, this version has an extra further recess 46 in the lateral tongue 13, forming a further upper lip 68 and a further lower lip 45 in the first coupling profile. The further upper lip 68 comprises an upward flank 69 with the upper part chamfered. This bevel 27 of the lateral tongue 13 connects the top surface 3 of the tile 1 and the upward flank 69. The bevel 27 of the lateral tongue 13 and the bevel 42 of the adjacent tile 1 form a niche 32. The bottom of the upward flank 69 transitions via the chamfer 38 on the lateral tongue 13 to the facial surface 70.

The further recess 46 is formed by the bottom surface 25 of the further upper lip 68, the top surface 24 of the further lower lip 45, and the inside flank 65 of the blocking lip 48. Optionally, the angle between the upward flank 17 and the top surface 24 of the further lower lip 45 can be beveled or rounded. In FIG. 12, the bottom surface 25 of the further upper lip 68 and the top surface 24 of the further lower lip 45 are drawn horizontally and flatly, while the upward flank 17 is drawn vertically and flat. However, this configuration is not required for the coupling to function correctly. To facilitate the production of the further recess 46, it may be preferable to slope the bottom surface 25 of the further upper lip 68 slightly toward the core 33 of tile 1.

The bevel 27 of the lateral tongue 13 can also have a rounded shape if this is easier to produce. The condition is that it can smoothly receive the tooth 51 of the third coupling profile 43 smoothly. The further lower lip 45 of the first coupling profile 4 features a blocking lip 19, composed of an inside flank 65, a head side 30, and a top 61. In the execution of the blocking lip 48, as shown in FIG. 12, the head side 30 is equipped with two chamfered corners on the top and bottom, respectively. This facilitates the insertion of the lateral tongue 13 into the recess 10 of the second locking means 12 and also ensures that recess 10 is better filled when the lateral tongue 13 is positioned in recess 10. The bottom side 26 of the lateral tongue 13 of the further lower lip 45 is at least partially chamfered and angled at a.

This angle $\alpha$ between the horizontal plane aligned with the bottom 2 of the tile 1 and the oblique plane of the bottom side 26 of lateral tongue 13 of the further lower lip 45 of the first coupling profile 4 is preferably between 10° and 45°, but preferably not less than 10° and at least 5°. On the back of the lateral tongue 13 on the side of the core 33 of the tile 1 is the blocking recess 15, which comprises a long downward flank 21, blocking recess 15 and short downward flank 20. The short downward flank 20 is preferably slightly chamfered and sloping, away from the core 33 of tile 1. This configuration facilitates connection to the blocking lip 48 of the second locking means 12, and ensures a better engagement of the first locking means 11 with the second locking means 12.

Figure 13:
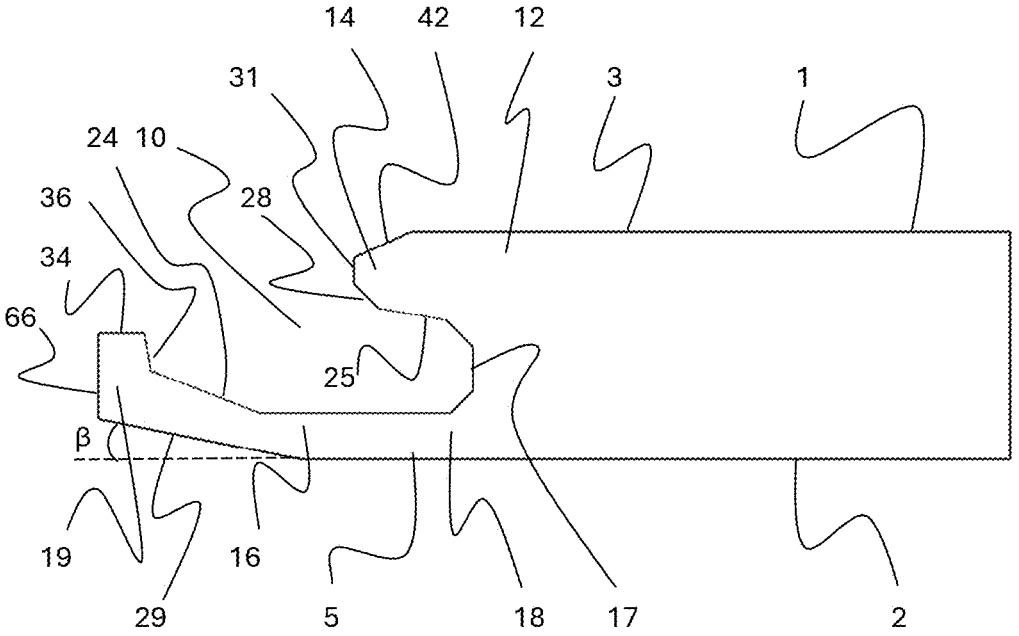
FIG. 13: Schematic side-view representation in detail of a tile with a second coupling profile according to an additional embodiment in which the second coupling profile can be connected to a first and/or third coupling profile.

A second locking means 12 according to the second embodiment is shown in FIG. 13, where the general structure of the coupling profile is essentially the same as the coupling profile shown in FIG. 5. The second locking means 12 features an upper lip 14 and a lower lip 16 separated by a recess 10. The bevel 42 of the upper lip 14 preferably has the same angle as the bevels on the first locking means 11, and the third locking means 44, giving the niche 32 formed by the coupled tiles 1 a symmetrical shape. The upper lip 14 also has a head side 31 and chamfer 28. The head side 31 contacts the upward flank 69 of the first coupling profile 4 when coupled with the first coupling profile 4 and contacts the head side 50 of the third coupling profile 43 when coupled with the third coupling profile 43.

The angle of the chamfer 28 is preferably the same as the angle of the chamfer 38 on the lateral tongue 13 of the first coupling profile 4. This feature contributes to a watertight connection. The top surface 24 of the lower lip 16 is preferably at least partially chamfered and preferably has the same shape as the bottom side 26 of the lateral tongue 13 of the first coupling profile 4, where the angle of the beveled part of the top surface 24 of the lower lip 16 matches the angle of the beveled part of the bottom side 26 of the lateral tongue 13 of the first coupling profile, resulting in the same angle α. The end of the lower lip 16 is also equipped with a blocking lip 19. The blocking lip 19 includes a top 34, an inside flank 36, and a head flank 66.

The inside flank 36 is preferably slightly sloped toward the core 33 of tile 1 and preferably has the same angle as the short downward flank 20 of the first coupling profile 4 and the first flank 58 of the first blocking recess 49 of the third coupling profile 43. The transition between the top 34 and the inside flank 36 can be beveled, but the chamfer should preferably be limited and rounded.

The bottom part 29 of the lower lip 16 is set at a certain angle β. The angle β between the horizontal plane aligned with the bottom 2 of tile 1 and the bottom part 29 of the lower lip 16 is preferably between 10° and 45°, but preferably not less than 10° and at least 5°.

Figure 14:
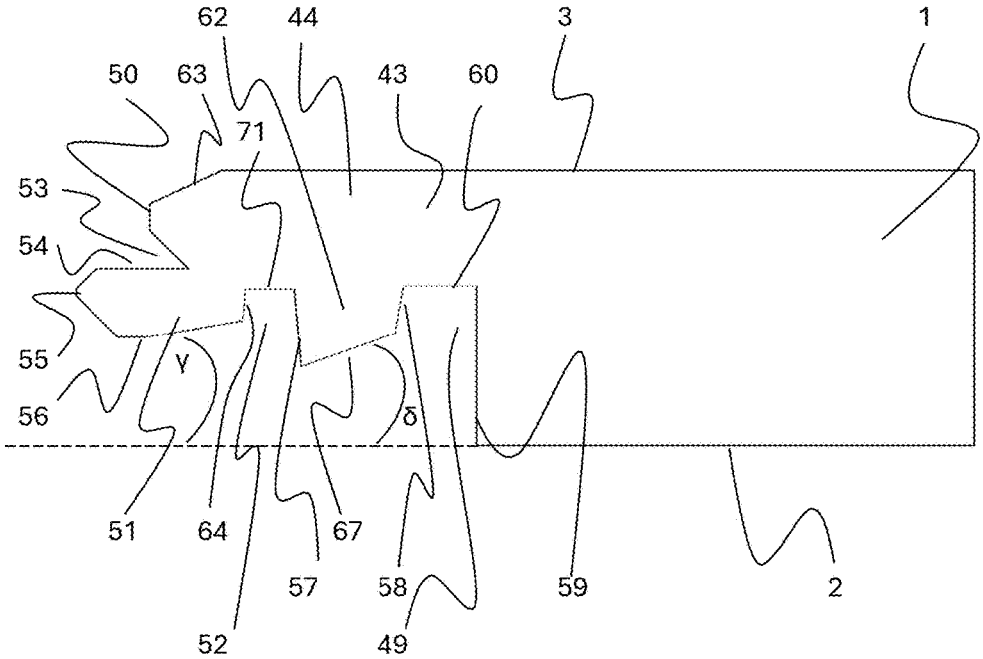
FIG. 14: Schematic side-view representation in detail of a tile with a third coupling profile according to an additional embodiment in which the third coupling profile can be connected to a first and/or second coupling profile.

A third coupling profile 43, according to the second embodiment, is shown in FIG. 14, where the general structure of the coupling profile functions as a universal coupling due to its structure allowing it to be coupled with both a first and second coupling profile. The basis of the third coupling profile 43 comprises a tooth 51, in combination with a first blocking recess 49 and a second blocking recess 52. The tooth 51 has a top surface 55, a lower surface 56, and an upper surface 54. The top surface 55 is preferably vertical and straight in shape, with both the bottom and top of the top surface 55 preferably beveled or rounded. If these are beveled, the upper bevel has a greater angle than the angle of the bottom surface 25 of the upper lip 14 of the second coupling profile 5 relative to the top surface 3 of tile 1.

The lower chamfer of the lower surface on the top surface 55 preferably has the same angle as the chamfered corner on the bottom of the upward flank 17 on the second coupling profile 5. The lower surface 56 is at least partially equipped with a sloping flank at an angle γ. The angle γ between the horizontal plane aligned with the bottom 2 of tile 1 and the bottom part 56 of the lower surface of tooth 51 is preferably between 10° and 45°, but preferably not less than 10° and at least 5°.

The third coupling profile 43 is equipped with two blocking recesses, of which the first blocking recess 49 is positioned on the side of core 33 of tile 1. This first blocking recess 49 comprises a first flank 58, a second flank 59, and an upper side 60. The second flank 59 is preferably vertically arranged and straight in shape, with this second flank 59 forming the connection between the bottom 2 of the tile 1 and the upper side 60. The first flank 58 is preferably slightly sloping away from the core 33 of tile 1 to form a smooth connection with the inside flank 36 of the second coupling profile 5. The first flank 58 preferably has a surface and angle similar to the inside flank 36 of the blocking lip 19 of the second coupling profile 5.

The second blocking recess 52 is positioned between the tooth 51 and the first blocking recess 49, with the separation between the second blocking recess 52 and the first blocking recess 49 formed by the intermediate profile 62. The intermediate profile 62 is composed up of the second flank 57 of the second blocking recess 52, the first flank 58 of the first blocking recess 49 and the lower surface 67 where the lower surface 67 of the intermediate profile 62 slopes away from the core 33 of tile 1 and where the angle δ between the horizontal plane that is aligned with the bottom 2 of tile 1 and the lower surface 67 of intermediate profile 62 is preferably between 10° and 45°, but more preferably not less than 10° and at least 5°.

The second blocking recess 52 is composed of a second flank 57, a first flank 64, and an upper side 71. The upper side 71 preferably connects the second flank 57 and the first flank 64 in a horizontal direction. The second flank 57 is preferably slightly slanted, sloping toward the core 33 of tile 1. The upper surface 54 of tooth 51 is preferably somewhat slanted, sloping in the direction away from the core 33 of tile 1 and at the same angle as the inside flank 65 of the further lower lip 45 of the first coupling profile 4.

The head side 50 is preferably equipped with two beveled surfaces, the upper one being bevel 63, which, in combination with the bevel of the coupled tile 1, forms a niche 32. The angle of bevel 63 of the third locking means 44 is preferably the same as the bevel of the first coupling profile 4 and the second coupling profile 5 on the other tiles 1.

The lower beveled side that opens onto the upper surface 54 of the tooth 51 forms the recess 53 in the head side 50 of the third coupling 43. This recess is preferably point-shaped, but this is optional for proper operation.

As mentioned, the first coupling profile 4 can be coupled with the second coupling profile 5, the third locking means 44 with the second coupling profile 5, and the third locking means 44 with the first coupling profile 4.

Figure 15:
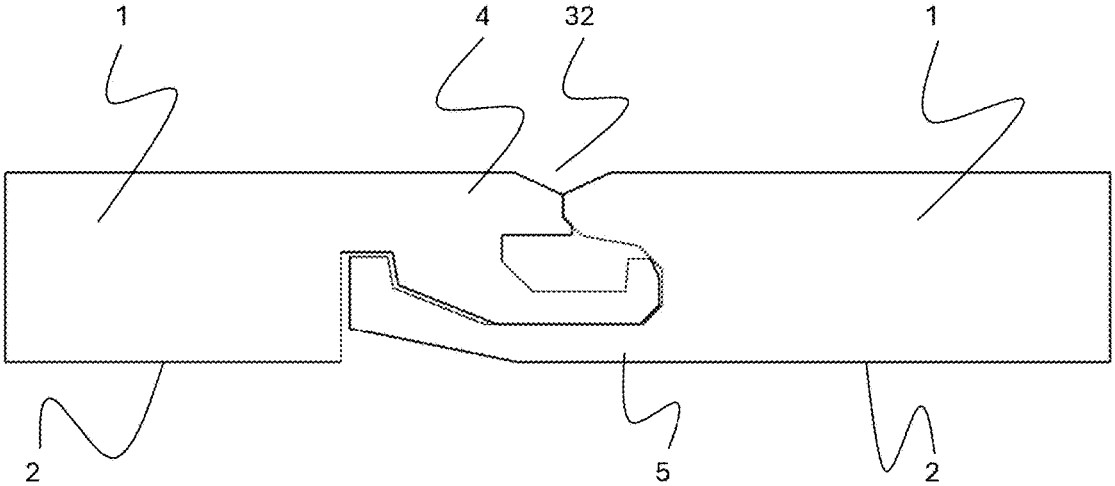
FIG. 15: Schematic representation in a detailed side view according to an additional embodiment of two connected tiles, one of which is provided with a first coupling profile and a second tile with a second coupling profile.

FIG. 15 shows a setup in which the first coupling profile 4 is coupled with the second coupling profile 5, as shown in FIGS. 7, 8, 9, 10, and 11. Again, the first coupling profile 4 can be inserted into the second coupling profile 5 via a tilting movement as in FIG. 11, or via a downward scissoring movement as shown in FIGS. 8, 9 and 10 where the oblique part of the bottom side 26 of the lateral tongue 23 of the first coupling profile 4 is placed on top 34 of the blocking lip 19 of the second coupling profile 5 The lower lip 16 will be pushed down and bent around the spring point 18. Once the lateral tongue 13 has reached a horizontal position, it will also be positioned in the recess 10 of the second coupling profile 5 by the vertical force converted into horizontal direction by the force exerted by blocking lip 19 of the second coupling profile 5 on the oblique plane of the bottom side 26 of lateral tongue 13 of the first coupling profile 4. Once the lateral tongue 13 is positioned, the lower lip 16 springs back to its original position, and the lateral tongue 13 is horizontally secured by the blocking lip 19 of the second coupling profile 15.

Figure 16:
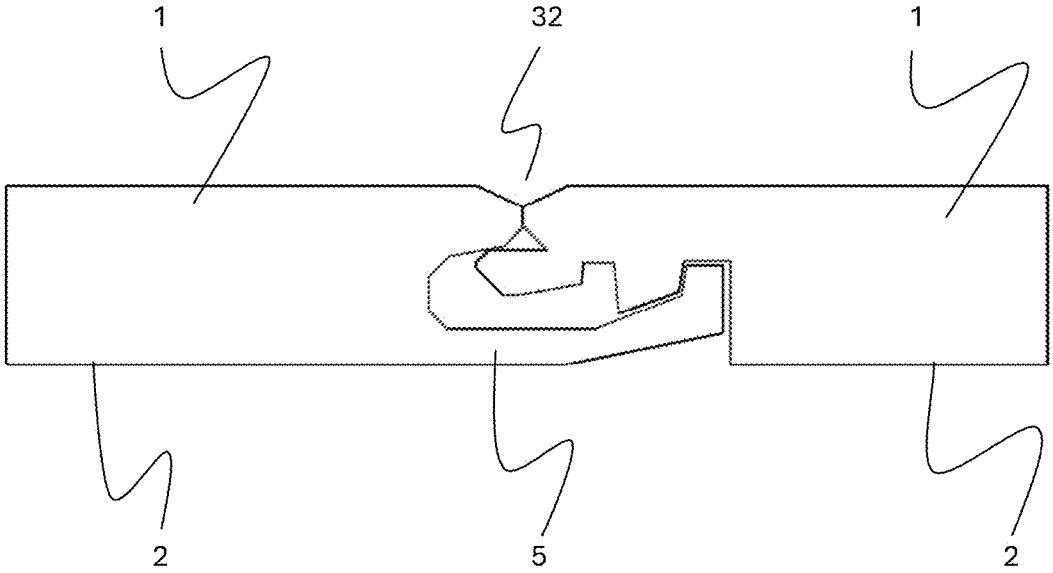
FIG. 16: Schematic representation in detail, from a side view, according to an additional embodiment of two connected tiles, where one tile is provided with a third coupling profile and a second tile is equipped with a second coupling profile.

FIG. 16 shows a setup in which the second coupling profile 5 is coupled with the third coupling profile 43, as shown in FIGS. 7, 8, 9, 10, and 11.

Again, the third coupling profile 43 can be inserted into the second coupling profile 5 via a tilting movement as in FIG. 11 or via a downward scissoring movement as shown in FIGS. 8, 9, and 10 where the oblique part of the intermediate profile 62 of the third locking means 44 is pressed against the top 34 of the blocking lip 19 of the second coupling profile 5. The lower lip 16 will be pushed down and bent, primarily around the spring point 18.

When the tooth 51 reaches a horizontal position, it also fits into the recess 10 of the second coupling profile 5 due to the vertical force that is converted into a horizontal direction by the force exerted by blocking lip 19 of the second coupling profile 5 on the sloped surface of the lower surface 67 of the intermediate profile 62 of the third locking means 44.

Once the tooth 51 is positioned, the lower lip 16 returns to its original position, and the tooth 51 is horizontally secured by the blocking lip 19 of the second coupling profile 15.

Figure 17:
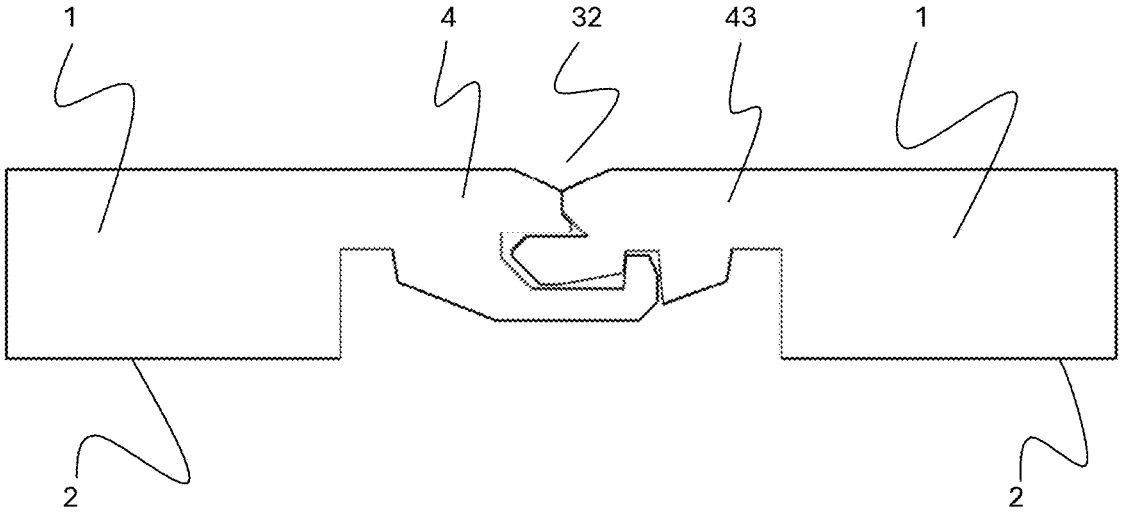
FIG. 17: Schematic representation in detail, from a side view, according to an additional embodiment of two connected tiles, where one tile is provided with a first coupling profile and a second tile is equipped with a third coupling profile.

FIG. 17 illustrates a setup in which the first coupling profile 4 is coupled with the third coupling profile 43, as shown in FIGS. 7, 8, 9, 10, and 11.

Here the third coupling profile 43 can be inserted into the first coupling profile 4 using either a tilting movement similar to FIG. 11 or via a downward scissoring movement as shown in FIGS. 8, 9, and 10 where the oblique part of the intermediate profile 62 of the third locking means 44 is pressed against the top 61 of the blocking lip 48 of the first coupling profile 4.

The further lower lip 45 is pushed down and bent, primarily around the spring point 47.

When tooth 51 reaches a horizontal position, it fits into the further recess 46 of the first coupling profile 4 due to the vertical force converted into the horizontal direction by the force exerted by the top 61 of the blocking lip 48 of the first coupling profile 4 on the sloping surface of the lower surface 67 of the intermediate profile 62 of the third locking means 44.

Once tooth 51 is positioned, the further lower lip 45 returns to its original position, and tooth 51 is horizontally secured by the blocking lip 48 of the first coupling profile 4.

What is claimed is:

1. A multi-purpose tile system comprising a plurality of multi-purpose tiles, each tile having a top and a bottom, wherein each tile comprises: a first pair of opposite edges consisting of a first edge and an opposite second edge; and a second pair of opposite edges consisting of a third edge and an opposite fourth edge;

wherein the first edge comprises a first mechanical coupling part comprising a lateral tongue, the lateral tongue being connected to the first edge via a recessed connection section, the connection section being formed by a blocking recess that extends from the bottom of the tile in a direction of the top of the tile, wherein the lateral tongue comprises a distally downward sloping bottom side, and wherein the second edge includes a second mechanical coupling part, configured to cooperate with the first mechanical coupling part of another of such tiles so as to couple two of such tiles together, the second mechanical coupling part comprising a lower lip and an upper lip defining a recess, said recess configured for accommodating the lateral tongue of a second of the tiles so that two of such tiles, when coupled, are locked together in a vertical direction, wherein the lower lip extends beyond a distal end of the upper lip and comprises a blocking lip at its distal end, wherein the blocking lip is configured to be accommodated in the blocking recess of the second of the tiles so that two of such tiles, when coupled, are locked together in a horizontal direction, and wherein the lower lip is configured to elastically bend downwards upon coupling two of such tiles so as to be able to push the lateral tongue, with the blocking lip against the distally downward sloping bottom side of the lateral tongue, into the recess defined by the upper lip and the lower lip when returning fully or partially to its relaxed state;

wherein a spring point is defined at a transition between the second edge and the lower lip, and the lower lip comprises a distally upwardly sloping bottom side allowing the lower lip to elastically bend downwards from the spring point during coupling of two of such multi-purpose tiles, thereby enlarging the recess defined by the upper lip and the lower lip for insertion of the lateral tongue.

2. The multi-purpose tile system according to claim 1, wherein the distally downward sloping bottom side of the lateral tongue forms an angle (a) with a plane parallel to the tile of at least 5 degrees.

3. The multi-purpose tile system according to claim 1, wherein an upper side of the blocking lip comprises a guiding surface sloping downwards towards the recess formed by the upper lip and the lower lip, this guiding surface being configured to cooperate with the distally downward sloping bottom side of the tongue so as to guide the lateral tongue, upon coupling two of such tiles together, into the recess formed by the upper lip and the lower lip.

4. The multi-purpose tile system according to claim 1, wherein the first mechanical coupling part and the second mechanical coupling part are configured so as to allow coupling two of such tiles by a scissoring movement of one tile with respect to the other tile along the respective edges.

5. The multi-purpose tile system according to claim 4, wherein the lower lip pushes the lateral tongue into the recess defined by the upper lip and the lower lip when the tile reaches a horizontal orientation during said scissoring movement.

6. The multi-purpose tile system according to claim 1, wherein the first mechanical coupling part and the second mechanical coupling part are configured to allow two of such tiles to be coupled using a scissoring movement of one tile with respect to the other tile, as well as using a turning movement of one tile with respect to the other tile.

7. The multi-purpose tile system according to claim 1, wherein the lateral tongue transitions into the recessed connection section via a downward side flank, positioned proximally from the distally downward sloping bottom side of the lateral tongue, and wherein the blocking lip comprises an inside flank, which is configured to cooperate with the downward side flank of the lateral tongue to lock two of such tiles together in the horizontal direction.

8. The multi-purpose tile system according to claim 1, wherein an upper side of the lateral tongue comprises a first locking surface, and wherein a lower side of the upper lip includes a second locking surface, which is configured to cooperate with the first locking surface of the lateral tongue to lock two of such tiles together in the vertical direction.

9. The multi-purpose tile system according to claim 1, wherein an upper side of the lateral tongue comprises a guiding surface sloping downward towards the distal end of the tongue, and wherein a lower side of the upper lip includes a guiding surface sloping upwards towards the distal end of the upper lip, which is configured to cooperate with the guiding surface at the upper side of the tongue so that, upon coupling two of such tiles, the lateral tongue is guided into the recess formed by the upper lip and the lower lip.

10. The multi-purpose tile system according to claim 9, wherein the respective guiding surfaces at the upper side of the lateral tongue and the lower side of the upper lip are configured to cooperate when the lower lip pushes the lateral tongue into the recess defined by the upper lip and the lower lip.

11. The multi-purpose tile system according to claim 1, wherein the lateral tongue and the recess defined by the upper lip and the lower lip are configured so that, when two of such tiles are coupled together, the lateral tongue is clamped into the recess.

12. The multi-purpose tile system according to claim 1, wherein the lower lip is configured to bend back only partially when two of such tiles are coupled so that the lateral tongue is clamped into the recess.

13. The multi-purpose tile system according to claim 1, wherein the recessed connection section has a thickness lower than half of the thickness of the tile.

14. The multi-purpose tile system according to claim 1, wherein the distally downward sloping bottom side of the tongue slopes downward over at least 50% of a maximum width of the lateral tongue.

15. The multi-purpose tile system according to claim 1, wherein slopes of top and bottom surfaces of the lower lip are substantially equal to a slope of a bottom surface of the lateral tongue.

16. The multi-purpose tile system according to claim 1, wherein the upper lip comprises a beveled or chamfered distal top end, wherein when the first and second coupling parts of the tiles are coupled, said beveled or chamfered distal top end forming a gully with the chamfered or beveled top of the lateral tongue.

17. The multi-purpose tile system according to claim 1, wherein the bottom of the lateral tongue comprises a downward extending tooth at the distal end thereof, said tooth defining an additional point at an apex of the tooth, wherein the tooth is defined by two lateral flanks which have a greater slope than a slope of the bottom of the lateral tongue, and wherein the recess of the second coupling comprises an additional recess at a proximal end thereof, near the second edge, said additional recess being defined by two lateral flanks which have a greater slope than a slope of the bottom of the recess, and wherein said additional recess is configured for accommodating the tooth and the additional point when the first and second coupling of the tiles are coupled.

18. The multi-purpose tile system according to claim 17, wherein the spring point is provided at the additional recess.

19. The multi-purpose tile system according to claim 1, wherein the lower lip comprises an extra protrusion at the bottom part near the second edge, which extra protrusion forms an extension of the bottom of the tile parallel thereto over part of a length of the lower lip, wherein said part is horizontally distanced from a proximal flank of the blocking lip by a predetermined minimal length.

20. The multi-purpose tile system according to claim 19, wherein said extra protrusion forms a right angle with respect to the bottom of the tile, towards the bottom of the lower lip.

21. The multi-purpose tile system according to claim 1, wherein the first mechanical coupling part and/or the second mechanical coupling part are made in one piece with the respective multi-purpose tile.

22. The multi-purpose tile system according to claim 1, wherein the multi-purpose tiles have a thickness of a maximum of 5 millimeters.

23. The multi-purpose tile system according to claim 1, wherein the third edge has a third mechanical coupling part which has substantially the same shape as the first mechanical coupling part, and wherein the fourth edge has a fourth mechanical coupling part which has substantially the same shape as the second mechanical coupling part.

24. A multi-purpose tile system comprising a plurality of multi-purpose tiles, each tile having a top and a bottom, wherein each tile comprises: a first pair of opposite edges consisting of a first edge and an opposite second edge; and a second pair of opposite edges consisting of a third edge and an opposite fourth edge;

wherein the first edge comprises a first mechanical coupling part comprising a lateral tongue, the lateral tongue being connected to the first edge via a recessed connection section, the connection section being formed by a blocking recess that extends from the bottom of the tile in the direction of the top of the tile, wherein the second edge comprises a second mechanical coupling part, configured to cooperate with the first mechanical coupling part of another of such tiles so as to couple two of such tiles together, the second mechanical coupling part comprising a lower lip and an upper lip defining a recess, said recess configured for accommodating the lateral tongue of a second of the tiles, so that two of such tiles, when coupled, are locked together in a vertical direction, wherein the lower lip extends beyond a distal end of the upper lip, the lower lip comprising a blocking lip at the distal end thereof, wherein the blocking lip is configured for being accommodated in the blocking recess of a second of the tiles, so that two of such tiles, when coupled, are locked together in a horizontal direction, wherein the first mechanical coupling part and the second mechanical coupling part are configured so as to allow coupling two of such tiles together by a scissoring movement of one tile with respect to the other tile along the respective edges, wherein the lower lip is configured to elastically bend downwards upon coupling two of such tiles by means of said scissoring movement, so as to be able to push the lateral tongue into the recess defined by the upper lip and the lower lip when returning fully or partially to its relaxed state;

wherein a spring point is defined at a transition between the second edge and the lower lip, and the lower lip comprises a distally upwardly sloping bottom side allowing the lower lip to elastically bend downwards from the spring point during coupling of two of such multi-purpose tiles, thereby enlarging the recess defined by the upper lip and the lower lip for insertion of the lateral tongue.

25. The multi-purpose tile system according to claim 24, wherein the lateral tongue is moved at least in the horizontal direction when pushed by the lower lip into the recess defined by the upper lip and the lower lip.

26. The multi-purpose tile system according to claim 24, wherein the lateral tongue comprises a further lower lip and a further upper lip defining a further recess, wherein the further lower lip extends beyond the distal end of the further upper lip, the further lower lip comprising a further blocking lip at the distal end thereof, wherein the further upper lip comprises a facial surface protrusion protruding distally at the bottom of the further upper lip, wherein, when two of such tiles are coupled, the head flank protrusion is positioned at least partly beneath the upper lip, such that the two tiles are locked together in a vertical direction, and wherein the further lower lip is configured to elastically bend upwards upon coupling of the two tiles so as to be able to push the facial surface protrusion against the upper lip when the further lower lip returns fully or partially to its relaxed state.

27. The multi-purpose tile system according to claim 24, further comprising one or more additional tiles which each comprise:

a first pair of opposing edges consisting of a first edge and an opposite second edge; and a second pair of opposing edges consisting of a third edge and an opposing fourth edge;

wherein the first edge of the additional tiles is either a first edge according to the first edge of the tiles or according to the second edge of the tiles;

wherein the second edge of the additional tiles includes a third mechanical coupling part, configured to cooperate with either of the first or second mechanical coupling part of another of such tiles so as to couple two of such tiles together, the third mechanical coupling part comprising a third locking means being connected to the first edge via a recessed connection section, the connection section being formed by a first blocking recess that extends from the bottom of the tile in the direction of the top of the tile, wherein the third locking means comprises at its distal end a head side at the upper part and a tooth at the lower part, wherein a head flank recess extends into the distal end of the third locking means and separates the head side and the tooth, wherein the tooth protrudes further than the head side, and comprises a distally downward sloping bottom side;

wherein the third locking means comprises a second blocking recess that extends from the bottom of the tile in the direction of the top of the tile at a more distal position than the first blocking recess, and wherein an intermediate profile between the first and second blocking recess slants downwardly in a distal direction, and wherein the second blocking recess is positioned between the intermediate profile and the tooth;

wherein when the third mechanical coupling part is coupled with the first mechanical coupling part of another such tile, the tooth is configured to be accommodated in the further recess and the facial surface protrusion to be accommodated in the head flank recess so that two of such tiles, when coupled, are locked together in the vertical direction, and wherein the further blocking lip is configured to be accommodated in the second blocking recess, so that two of such tiles, when coupled, are locked together in the horizontal direction, and wherein the further lower lip is configured to elastically bend downwards upon coupling two of such tiles, so as to be able to push the third mechanical coupling part, with the further blocking lip against the distally downward sloping bottom side of the tooth, into the further recess defined by the further upper lip and the further lower lip when returning fully or partially to its relaxed state; and wherein when the third mechanical coupling part is coupled with the second mechanical coupling part of a second of the tiles, the head side and the upper lip are configured to interface, and the tooth is configured to be accommodated in the recess against the bottom side of the upper lip, so that the two tiles, when coupled, are locked together in the vertical direction, and wherein the blocking lip of the second mechanical coupling part is configured for being accommodated in the first blocking recess of the third mechanical coupling part, so that the two tiles, when coupled, are locked together in the horizontal direction, and wherein the lower lip of the second mechanical coupling part is configured to elastically bend downwards upon coupling the two tiles, so as to be able to push the third mechanical coupling part, and in particular the tooth, with the blocking lip of the second mechanical coupling part against the distally downward sloping bottom side of the tooth, into the recess defined by the upper lip and the lower lip of the second mechanical coupling part when returning fully or partially to its relaxed state.

* * * * *